US010406416B2

(12) United States Patent
Cohen et al.

(10) Patent No.: US 10,406,416 B2
(45) Date of Patent: Sep. 10, 2019

(54) SOCIAL GAMING DEVICE

(71) Applicant: LCB Golf Concepts, LLC, Atlanta, GA (US)

(72) Inventors: Stosh Cohen, Atlanta, GA (US); Matthew Bravo, Canton, GA (US); Daniel Lutz, Atlanta, GA (US)

(73) Assignee: LCB Golf Concepts, LLC, Atlanta, GA (US)

( * ) Notice: Subject to any disclaimer, the term of this patent is extended or adjusted under 35 U.S.C. 154(b) by 277 days.

(21) Appl. No.: 15/193,226

(22) Filed: Jun. 27, 2016

(65) Prior Publication Data

US 2017/0128805 A1 May 11, 2017

Related U.S. Application Data

(60) Provisional application No. 62/252,572, filed on Nov. 8, 2015.

(51) Int. Cl.

| | |
|---|---|
| ***A63B 67/02*** | (2006.01) |
| *A63B 57/40* | (2015.01) |
| *A63B 71/06* | (2006.01) |

(52) U.S. Cl.

CPC ..... *A63B 67/02* (2013.01); *A63B 57/40* (2015.10); *A63B 71/0616* (2013.01); *A63B 71/0669* (2013.01); *A63B 2067/025* (2013.01); *A63B 2071/0625* (2013.01); *A63B 2071/0655* (2013.01); *A63B 2210/50* (2013.01); *A63B 2225/20* (2013.01)

(58) Field of Classification Search

CPC ..... A63F 7/249; A63B 67/02

USPC ..... 273/127 B, 352; 473/157, 162; 297/31, 297/22, 23, 16.1

See application file for complete search history.

(56) References Cited

U.S. PATENT DOCUMENTS 922,717 A * 5/1909 Parker ..... A63B 67/06 273/401

1,952,187 A 3/1934 Wade (Continued)

OTHER PUBLICATIONS

Puttskee, Aug. 1, 2015, https://web.archive.org/web/20150801161945/http://www.theputtskee.com:80/store/p1/The_Puttskee.html, All Pages.*

(Continued)

*Primary Examiner* — John E Simms, Jr.
*Assistant Examiner* — Rayshun K Peng
(74) *Attorney, Agent, or Firm* — Womble Bond Dickinson (US) LLP

(57) ABSTRACT

A gaming device includes a base, a runway, and a target. The base includes a baseplate and a ramp. The base plate has an upper surface and a leading end. The ramp includes a ramp leg that supports the ramp in an inclined position. The runway has a free end that extends from the leading end of the base plate in a deployed configuration of the gaming device. The target includes a target plate having a target surface that defines a plurality of holes. The target plate is hingedly attached to the base plate such that the base plate is foldable into the target in a transport configuration of the gaming device. In the transport configuration, the upper surface of the base plate opposes the target surface of the target plate with the ramp disposed between the upper surface and the target surface.

20 Claims, 17 Drawing Sheets

(56) References Cited

U.S. PATENT DOCUMENTS

| | | | | |
|---|---|---|---|---|
| 2,144,439 | A * | 1/1939 | Duffy | A63B 57/40 473/160 |
| 2,381,149 | A * | 8/1945 | Wenneborg | A47C 4/40 297/23 |
| 3,540,733 | A | 11/1970 | LaMattina | |
| 3,727,918 | A | 4/1973 | Zawacki | |
| 3,990,573 | A | 11/1976 | Cross | |
| 4,017,084 | A | 4/1977 | Jeffery | |
| 4,596,391 | A | 6/1986 | Carolan, Jr. | |
| 4,691,923 | A | 9/1987 | Schwartz | |
| 5,031,919 | A * | 7/1991 | Dixon | A63F 7/0005 273/352 |
| 7,294,062 | B2 | 11/2007 | Ting | |
| 7,563,171 | B2 | 7/2009 | Barz | |
| 8,376,871 | B1 | 2/2013 | Cloud | |
| 8,864,596 | B1 * | 10/2014 | Maranian, Jr. | A63B 69/3661 473/162 |
| 2002/0082100 | A1 * | 6/2002 | Moore | A63B 63/08 473/160 |
| 2003/0096658 | A1 | 5/2003 | Elliott | |
| 2011/0127716 | A1 | 6/2011 | Egan et al. | |
| 2012/0021845 | A1 | 1/2012 | Slavik | |
| 2014/0309052 | A1 | 10/2014 | Ligrow et al. | |
| 2014/0364244 | A1 | 12/2014 | Ross | |
| 2015/0087432 | A1 | 3/2015 | Noto et al. | |

OTHER PUBLICATIONS www.theputtskee.com/store/c1/Featured_Products.html, last visited Sep. 23, 2016.
www.youtube.com/watch?v=k2FtXTE8glk, last visited Sep. 23, 2016.

* cited by examiner

SOCIAL GAMING DEVICE

CROSS-REFERENCE TO RELATED APPLICATION

This application claims the benefit of, and priority to, U.S. Provisional Patent Application Ser. No. 62/252,572, filed on Nov. 8, 2015, the entire contents of which are hereby incorporated by reference.

BACKGROUND

1. Technical Field

The present disclosure relates to gaming devices and, more specifically, to a social gaming device that combines golf, beer pong, and skeeball.

2. Discussion of Related Art

During social gatherings attendees frequently play games to socialize, pass the time, and provide entertainment. Some of these games are horse shoes, corn hole, beer pong, bocce, volleyball, lawn darts, etc. Attendees can be attracted by games that new and different from existing games. To allow attendees to learn and play the new games, the new games can have familiar gameplay and simple rules.

Some existing games, such as volleyball, have equipment that can be time-consuming and difficult to set up. In addition, some existing games require large areas to play which make them unsuitable for some social gatherings that have limited space, e.g., tailgating.

There is a continuing need for games that can be played at a variety of social gatherings that are have familiar gameplay, simple rules, use limited space, and are easy to setup.

SUMMARY

The present disclosure relates generally to a social game that has similar gameplay and simple rules while utilizing a gaming device that takes limited space, is easy to setup, and is portable. The social game has gameplay and rules which combine elements of golf, beer pong, and skeeball which are familiar to most people. The gaming device folds up into a small and portable transport configuration which can be stored in a closet or a trunk of a vehicle such that the gaming device can be available for planned and/or spontaneous social gatherings.

In an aspect of the present disclosure, a gaming device includes a base, a runway, and a target. The base includes a baseplate and a ramp. The base plate has an upper surface, a leading end, and a trailing end. The ramp includes a ramp leg that supports the ramp in an inclined position. The ramp leg has a first end that is rotatably secured to the ramp and a second end that rests on the upper surface of the base plate to support the ramp in the inclined position. The runway has a free end that extends from the leading end of the base plate in a deployed configuration of the gaming device. The target includes a target plate having a target surface that defines a plurality of holes. The target plate is hingedly attached to the base plate such that the base plate is foldable into the target in a transport configuration of the gaming device. In the transport configuration, the upper surface of the base plate opposes the target surface of the target plate with the ramp disposed between the upper surface and the target surface.

In aspects, the runway folds onto the base plate in the transport configuration of the gaming device such that the runway is disposed between the upper surface of the base plate and the target surface of the target plate in the transport configuration. The runway can include a lead-up section that extends from the leading edge of the base plate and a ramp section that is disposed over the ramp. The ramp section can be adhered to the upper surface of the base plate and an upside of the ramp to hingedly secure a leading edge of the ramp to the base plate. The ramp can have a flat position in which an underside of the ramp is in contact with the upper surface of the base plate. In the flat position of the ramp, the ramp leg can extend from a trailing edge of the ramp towards the trailing end of the base plate. In the flat position of the ramp, a side surface of the ramp leg can be in contact with the upper surface of the base plate.

In certain aspects, the upper surface of the base plate defines first and second grooves. The first and second grooves can be parallel to one another and transverse to a longitudinal axis of the gaming device in the deployed configuration. In the inclined position of the ramp, the second end of the ramp leg can be disposed in the first groove such that the ramp defines a first angle with the upper surface of the base plate. In an intermediate position of the ramp, the second end of the ramp leg can be disposed in the second groove such that the ramp defines a second angle with the upper surface of the base plate which is different from the first angle. The intermediate position may be between the inclined position and the flat position.

In some aspects, the target includes sidewalls and a backstop that both extend from an inside surface of the target plate. The sidewalls and the backstop can form a box with the target plate. In the transport configuration, the box can contain the runway and the ramp. The leading end of the base plate can be adjacent the backstop in the transport configuration of the gaming device.

In particular aspects, the target includes a pair of support legs. Each of the support legs can have a first end that is rotatably attached to a respective sidewall of the target adjacent a trailing end of the target and a second end that extends away from the first end. The second end can support the target in an inclined position in the deployed configuration of the gaming device. The target can include a cross-member that interconnects the second ends of the support legs. The target can include a retainer that has a first end secured to the target plate adjacent a leading end thereof and to the cross-member. The retainer can set a target angle between the upper surface of the base plate and the target plate in a deployed configuration of the gaming device when the second end of the target leg and the leading end of the target plate are supported on a common surface.

In certain aspects, the gaming device includes a hinge that is secured to the trailing end of the base plate and to the leading end of the target plate to hingedly attach the base plate to the target plate. The hinge can include a handle accessible when the gaming device is in the transport configuration.

In another aspect of the present disclosure, a method of deploying a gaming device includes placing the gaming device on a surface in a transport configuration with a leading end of a target plate adjacent the surface, tipping the target plate onto support legs such that the target plate defines a target angle with the surface, positioning a base plate away from the target plate such that a bottom surface of the base plate is supported by the surface and the upper surface of the base plate defines a target angle with the target plate, extending a runway from the base plate in a direction from the target plate, and lifting a trailing edge of a ramp that is hingedly attached at a leading end to the upper surface of the base plate such that an upside of the ramp defines a ramp angle with the upper surface of the base plate.

In aspects, the method includes releasing the support legs from against an outside surface of the target plate before tipping the target plate onto the support legs. The method may include rotating the support legs about a first end of each leg such that a second end of each support leg is spaced apart form a leading end of the target plate a predetermined distance. Rotating the support legs may include tensioning a retainer that is secured to the target plate adjacent a leading end thereof and to a cross-member that interlinks the second ends of the support legs. The retainer can have a length such that when the retainer is tensioned the second end of each support leg is spaced apart from the leading end of the target plate the predetermined distance.

In some aspects, placing the gaming device on the surface includes placing a bottom surface of the base plate on the surface and tipping the target plate onto the support legs includes lifting a trailing end of the target plate way from the leading end of the base plate. Extending the runway away from the base plate can include unfolding the runway from the base plate includes unfolding the runway from over the base plate. Lifting the trailing edge of the ramp can include rotating a ramp leg about a first end of the ramp leg, which is rotatably coupled to the ramp adjacent the trailing edge of the ramp such that a second end of the ramp leg is supported on the upper surface of the base plate when the second end of the ramp leg is supported on the supper surface of the base plate.

In certain aspect, the method includes adjusting the ramp angle by moving an end of a ramp leg pivotally coupled to the ramp from a first groove defined in the upper surface of the base plate to a second groove defined in the upper surface of the base plate.

Further, to the extent consistent, any of the aspects described herein may be used in conjunction with any or all of the other aspects described herein.

BRIEF DESCRIPTION OF THE DRAWINGS

Various aspects of the present disclosure are described hereinbelow with reference to the drawings, which are incorporated in and constitute a part of this specification, wherein.

DETAILED DESCRIPTION

Figure 1:
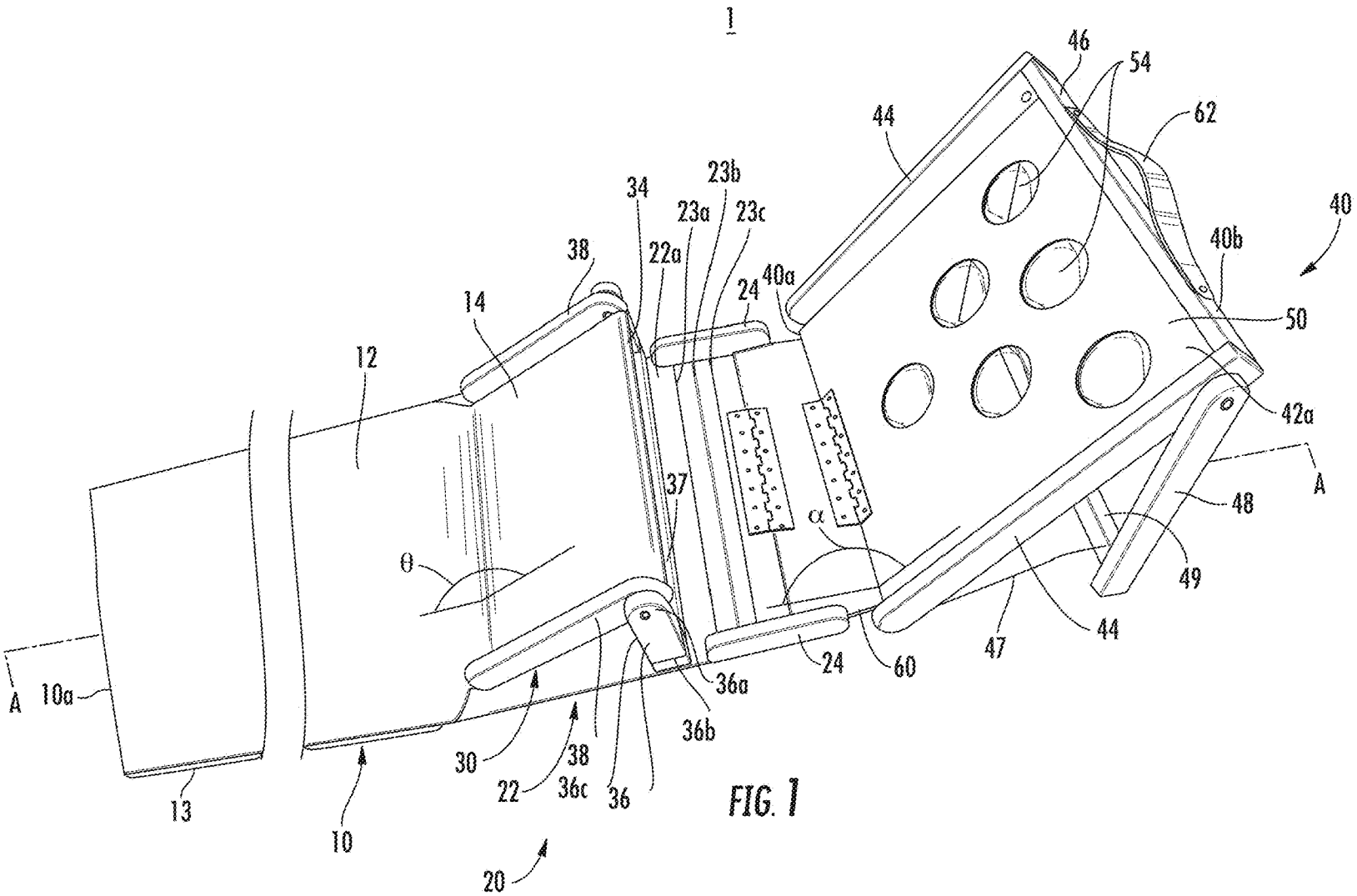
FIG. 1 is a perspective view of an exemplary gaming device in accordance with the present disclosure in a deployed configuration.

Embodiments of the present disclosure are now described in detail with reference to the drawings in which like reference numerals designate identical or corresponding elements in each of the several views.

Figure 2:
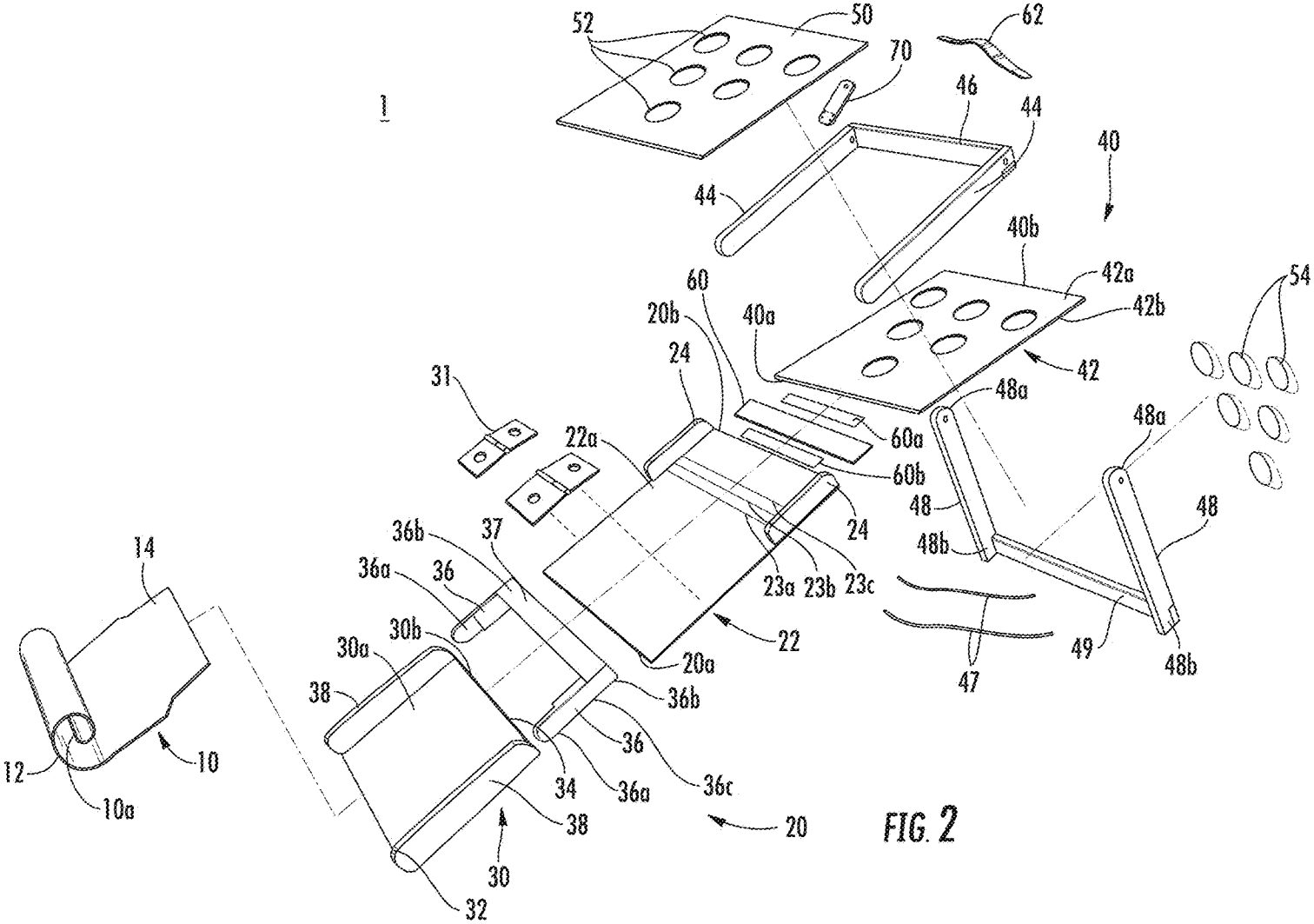
FIG. 2 is an exploded view, with parts separated, of the gaming device of FIG. 1.

Referring to FIGS. 1 and 2, a gaming device 1 is provided in accordance with the present disclosure and includes a runway 10, a base 20, and a target 40. As shown in FIG. 1, the gaming device 1 has a deployed configuration in which the gaming device 1 is configured to be used to play a game as detailed below. In addition, the gaming device 1 has a transport configuration (FIG. 7) in which the gaming device 1 is easily transportable and/or storable.

The runway 10 extends from the base 20 to provide a substantially smooth surface for a ball 110 (FIG. 13) to roll across. The base 20 includes a base plate 22 and a ramp 30 to provide an inclined surface for the ball 110 to travel across towards the target 40. The target 40 extends from the base 20 and is inclined relative to the base plate 22 to provide a target for the ball 110 as described in greater detail below.

The runway 10 includes a lead-up section 12 and a ramp section 14. In the deployed configuration the lead-up section 12 is substantially flat and extends from the base plate 22 to provide a substantially smooth surface approaching the ramp 30. As shown, the lead-up section 12 is constructed from a flexible material that can adapt to an underlying surface; however, it is contemplated that the lead-up section 12 may be constructed from a rigid or semi-rigid material that is foldable at discrete locations. As detailed below, the runway 10 may be rolled or folded in the transport configuration. The lead-up section 12 may have a length of about 12 inches to about 120 inches (e.g., about 60 inches).

The ramp section 14 of the runway 10 extends from the lead-up section 12 over the ramp 30. The ramp section 14 may fold over a trailing edge 34 of the ramp 30 and be attached to an underside **30*b* (FIG. 2) of the ramp 30. The ramp section 14 may have a width that is less than a width of lead-up section 12. For example, the lead-up section 12 may have a width of about 24 inches and the ramp section 14 may have a width of about 19 inches. The width of the lead-up section 12 may be slightly less than, equal to, or greater than a width of the base plate 22 and the width of the ramp section 14 may be approximately equal to a width of the ramp 30, which may be less than a width of the base plate 22. The runway 10 may be in the form of artificial turf with the ramp section 14 adhered to the ramp 30. The lead-up section 12 may include a backing 13** that conforms to irregularities in a surface and/or provides resistance to tearing, e.g., a rubber backing.

The base plate 22 is substantially rectangular and has an upper surface 22*a*, a lower surface 22*b*, a leading end 20*a*, and a trailing end 20*b*. In the deployed configuration the lower surface 22*b* is against the ground or similar surface to support the gaming device 1 and the upper surface 22*a* is exposed. The upper surface 22*a* may include side rails 24 that extend parallel to a longitudinal axis A-A of the gaming device 1 and are adjacent the target 40. The upper surface 22*a* defines grooves 23*a-c* between the side rails 24 that may be used to adjust an angle θ of the ramp 30 as detailed below. Each groove 23*a-c* may span across the entire upper surface 22*a* between the side rails 24 or be in the form of pairs of notches with one notch of each pair adjacent a respective side rail 24.

The ramp 30 includes a leading edge 32, a trailing edge 34, and legs 36. The leading edge 32 of the ramp 30 is hingedly secured to the upper surface 22*a* of the base plate 22. A portion of the lead-up section 12 may be adhered to the upper surface 22*a* adjacent the leading edge 32 of the ramp 30 with the ramp section 14 adhered to an upside 30*a* of the ramp 30 such that the runway 10 acts as a hinge at the leading edge 32 of the ramp 30. Additionally or alternatively, the ramp 30 may include a hinge 31 that is secured to the upper surface 22*a* of the base plate 22 and to the underside 30*b* of the ramp 30. The hinge 31 can be a single hinge along a substantial length of the leading edge 32 of the ramp 30 or can be multiple hinges positioned along the leading edge 32 to hingedly secure the ramp 30 to the base plate 22. It is alternatively contemplated that the hinge 31 can be secured to the upper surface 22*a* of the base plate 22 and to the upside 30*a* of the ramp 30.

The ramp 30 includes side rails 38 that extend upward from the sides of the ramp 30. As shown, the side rails 38 extend from the leading edge 32 to the trailing edge 34; however, it is envisioned that the side rails 38 may extend along only a portion of the sides of the ramp 30. The upper sides of the side rails 38 may be rounded adjacent the leading edge 32 and/or the trailing edge 34 of the ramp 30. Each leg 36 is includes a first end 36*a* that is rotatably coupled to one of the side rails 38 of the ramp 30. As shown, the first end 36*a* of each leg 36 is rotatably coupled to one of the side rails 38 adjacent the trailing edge 34 of the ramp 30; however, it is envisioned that each leg 36 may be rotatably coupled anywhere along the side rails 38. The legs 36 may be interconnected by a cross-member 37 that is attached adjacent a second end 36*b* of each leg 36. It is envisioned that the ramp 30 may include single collapsible leg (not shown) that is attached to the underside 30*b* of the ramp 30.

In the deployed configuration, the second ends 36*b* of the legs 36 rest upon the upper surface 22*a* of the base plate 22 such that the trailing end 34 of the ramp 30 is spaced apart from the upper surface 22*a* of the base plate 22. In the deployed configuration, the upside 30*a* of the ramp 30 defines an angle θ with the upper surface 22*a* of the base plate 22. The angle θ is in a range of about 120° to about 150° (e.g., about 140°).

Figure 13:
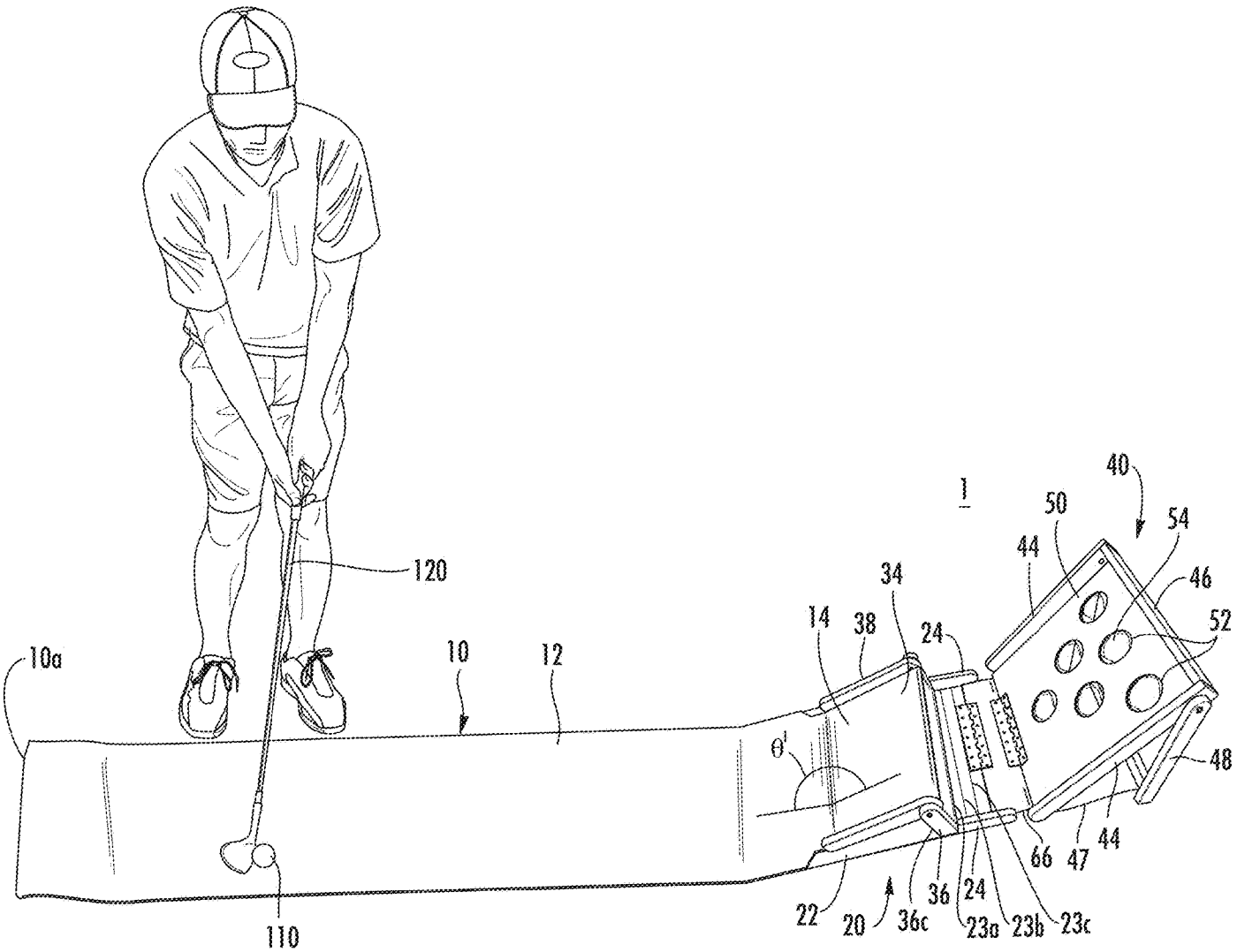
FIG. 13 is a perspective view of the gaming device of FIG. 12 in the deployed configuration with the ramp in an inclined position and a player striking a ball on the runway.

It is envisioned that in the deployed configuration of the gaming device 1 (FIG. 3), the angle θ can be adjusted between a number of discrete angles. The angle θ can have a first value when the second ends 36*b* of the legs 36 rest upon the upper surface 22*a* such that a plane defined by the second ends 36*b* is substantially co-planar with the upper surface 22*a* of the base plate 22 as shown in FIG. 1. The angle θ can have second value θ' (FIG. 13) when each side surface 36*c* of the legs 36 is received in one of the grooves 23*a-c* as shown in FIG. 13. Each groove 23*a-c* can define a discrete value of the angle θ. When each groove 23*a-c* is a pair of notches, it will be appreciated that each notch is sized and dimensioned to receive a respective second end 36*b* of the legs 36.

Figure 3:
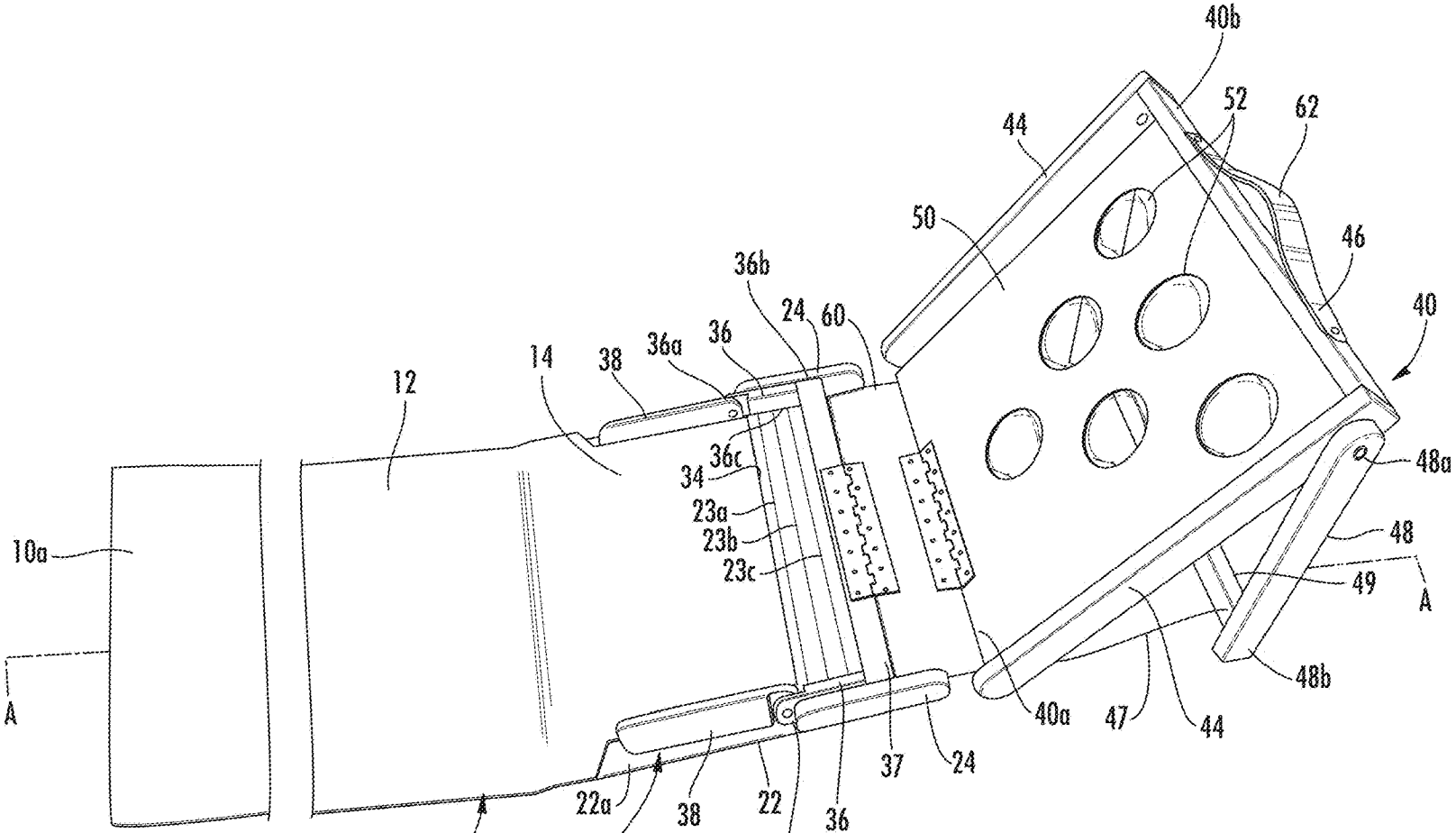
FIG. 3 is a perspective view of the gaming device of FIG. 1 with a ramp in a flat position.

The legs 36 are rotatably coupled to the side rails 38 of the ramp 30 such that the underside 30*b* of the ramp 30 and side surfaces 36*c* of the legs 36 can rest upon the upper surface 22*a* of the base plate 22 in a flat position of the ramp 30 (FIG. 3). In the flat position, the second ends 36*b* of the legs 36 may extend from the trailing end 34 of the ramp 30 towards the target 40. In addition, while in the transport configuration, the legs 36 lay within the side rails 24 of the base 20 as shown in FIG. 3. Further, each leg 36 may be between a side rail 24 of the base and a side rail 38 of the ramp 30 in the flat position.

Continuing to refer to FIG. 2, the target 40 has a leading end 40*a* that is hingedly attached to the trailing end 20*b* of the base 20 by a hinged member 60. The target 40 includes a target plate 42, sidewalls 44, a backstop 46, and legs 48. The target plate 42 is substantially rectangular and has an inner surface 42*a* and an outer surface 42*b*. The sidewalls 44 extend upward from the sides of the target plate 42 and the backstop 46 extends upward from an end of the target plate 42 adjacent the trailing end 40*b* of the target 40 to form three sides of a box about the target plate 42 with the inner surface 42*a* of the target plate 42 inside the box. Each leg 48 has a first end 48*a* that is rotatably coupled to one of the sidewalls 44. As shown, the first end 48*a* of each leg 48 is rotatably coupled adjacent the backstop 46; however, it is contemplated that the first end 48*a* of each leg 48 can be rotatably coupled anywhere along a respective sidewall 44. A second end 48*b* of each leg 48 is supported by the ground such that target plate 42 is upwardly inclined from the leading end 40*a* to the trailing end 40*b* such that the inner surface 42*a* forms an angle α with the upper surface 22*a* of the base plate 22. The second end 48*b* of each leg 48 may include a retainer 47 that is secured to the second end 48*b* and to the target plate 42 adjacent the leading end 40*a* of the target plate 42. The retainer 47 limits the angle α by limiting the rotation of the legs 48 about the first ends 48*a*. The angle α is in a range of about 120° to about 150° in the deployed configuration. The legs 48 may include a cross-member 49 interconnecting the second ends 48*b*.

The target plate 42 includes a target surface 50 that defines a plurality of holes 52 for receiving one or more balls 110 (FIG. 13). The target surface 50 may be a coating or cover applied to the inside surface 42*a* of the target plate 42. The target surface 50 may be a turf similar to turf of the runway 10. The target surface 50 may absorb or deaden impact, vibrations, and/or sound when the target surface 50 is contacted by a ball 110. In addition, the target surface 50 may provide visual indicia of a location of an impact. For example, the target surface 50 may plastically deform when impacted by a ball 110 and slowly recover such that the location of the impact may be observed during the recovery.

Each hole 52 is sized and dimensioned to allow a ball 110 to freely pass through the target plate 42. Each hole 52 may have a diameter in a range of about 3 inches to about 5 inches (e.g., about 4 inches). As shown, each hole 52 has a diameter substantially equal to the diameter of each other hole 52; however, it is contemplated that one or more holes 52 may have a diameter larger or smaller than the other holes 52. It is envisioned one or more holes 52 may represent a traditional hole on a golf course. Each hole 52 may include a pocket 54 secured to the hole 52 such that a ball 110 passing though the target plate 42 is captured in the pocket 54. The pocket 54 may be secured to the inside surface 42*a* of the target plate 42 or to the outside surface 42*b* of the target plate 42. When the pocket 54 is secured to the inside surface 42*a* of the target plate 42, a portion of the pocket 54 may be captured between the cover 50 and the target plate 42.

The holes 52 may be arranged in a variety of patterns. For example, as shown, the target plate 42 and the target surface 50 each define six holes 52 arranged in a triangle with one side parallel to the backstop 46 and a corner adjacent the leading end 40*a* of the target 40. It is contemplated that the target plate 42 and the target surface 50 may define ten holes 52 arranged in a triangle with one side parallel to the backstop 46 and a corner adjacent the leading end 40*a* of the target 40. It is envisioned that the target plate 42 and the target surface 50 may define between 1 and 36 holes arranged in a variety of patterns.

The hinged member 60 allows the target 40 to fold over the base 20 such that the inner surface 42*a* of the target plate 42 faces the upper surface 22*a* of the base plate 22 in the transport configuration. The hinged member 60 includes a first hinge 61*a* that attaches the hinged member 60 to the base plate 22 and a second hinge 61*b* that attaches the hinged member 60 to the target 40. As described in greater detail below, the runway 10 and the ramp 30 are disposed within the box defined by the sidewalls 44 and the backstop 46 of the target 40 with the hinged member 60 forming a wall opposite the backstop 46. The hinged member 60 is attached along the trailing end 20*b* of base 20 and along the leading end 40*a* of the target plate 42 to couple the base 20 to the target 40.

The gaming device 1 includes a handle 62 (FIG. 7) that is attached to the backstop 46. The handle 62 is capable of supporting the entire weight of the gaming device 1 and additional forces commonly experienced during transport and/or storage of the gaming device 1. Additionally, the gaming device 1 can include a carrying strap 64 (FIG. 8) which is attached to back stop 46 or the hinged member 60. As shown, the carrying strap 64 is attached to the sidewalls 44 of the target 40. The carrying strap 64 is also capable of supporting the entire weight of the gaming device 1 and additional forces commonly experienced during transport and/or storage of the gaming device 1. The carrying strap 64 can be releasably attached to the sidewalls 44. For example, the sidewalls 44 can each include a securement ring 66 and the carrying strap 64 can include clasps 65 at each end to releasably secure the carrying strap 64 to the securement rings 66 such that the carrying strap 64 can be used as a shoulder strap for carrying the gaming device 1.

With reference to FIGS. 3-7, a method of converting the gaming device 1 from the deployed configuration to the transport configuration will be described in detail in accordance with the present disclosure. Initially, referring to FIG. 3, the ramp 30 is collapsed from an inclined position (FIG. 1) to a flat position (FIG. 3). In the flat position, the legs 36 extend from the ramp 30 towards the target 40. In the flat position, the side surfaces 36*c* of the legs 36 are in contact with the upper surface 22*a* of the base plate 22. In addition, the ends 36*b* of the legs 36 are extended beyond the grooves 23*a-c* in the upper surface 22*a* of the base plate 22.

Figure 4:
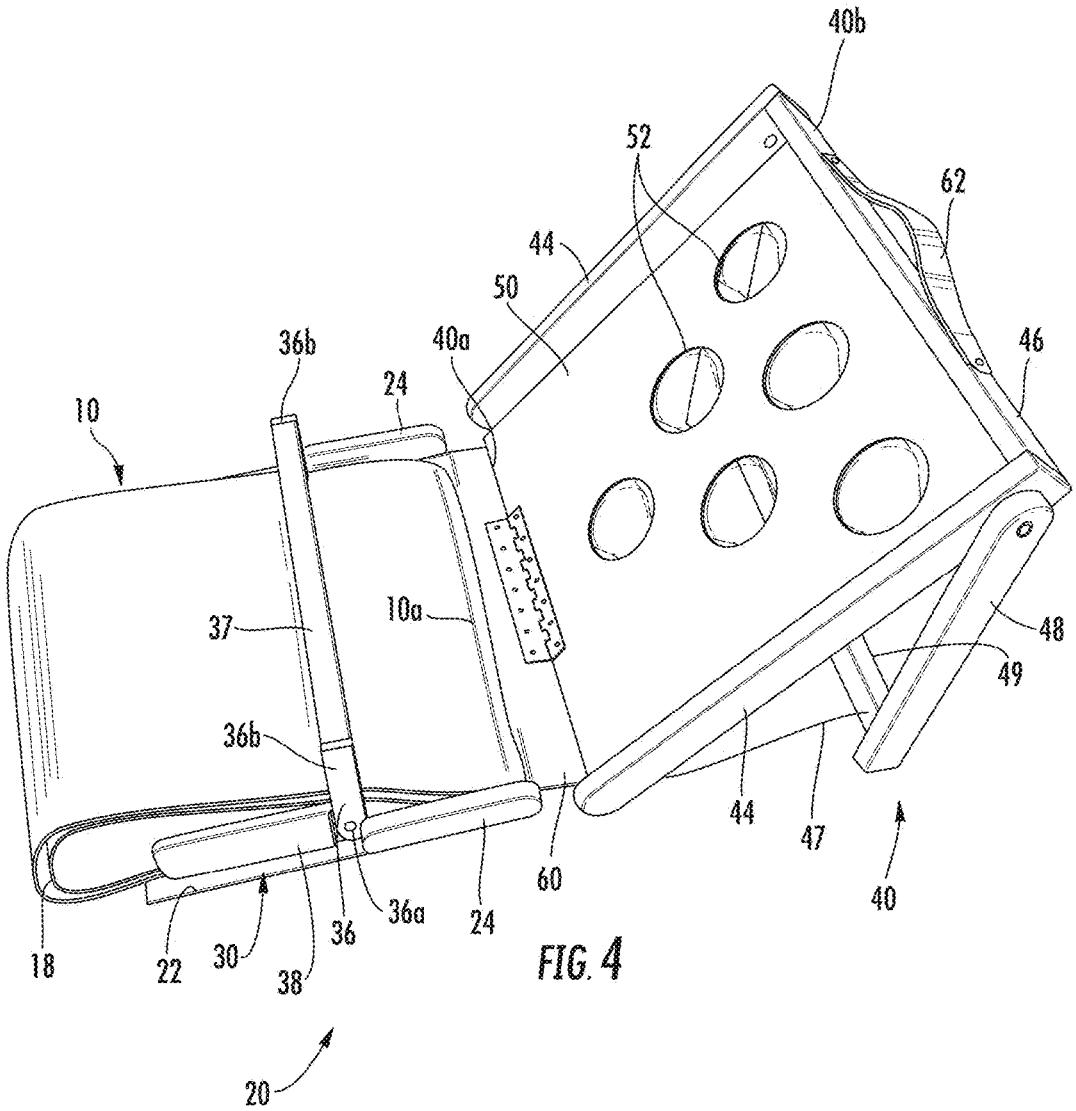
FIG. 4 is a perspective view of the gaming device of FIG. 3 with a runway folded over the ramp and partially onto a base plate.
Figure 5:
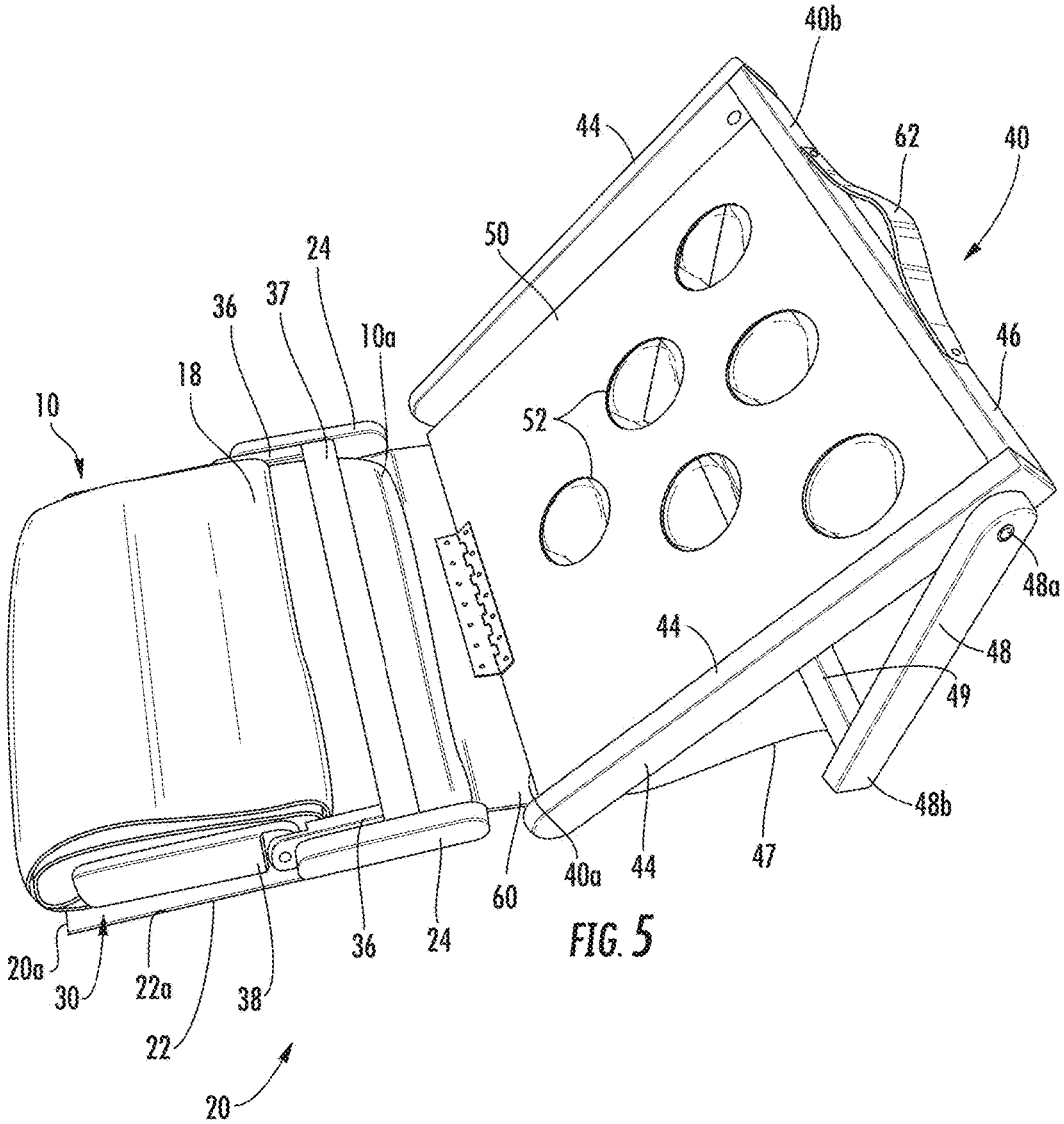
FIG. 5 is a perspective view of the gaming device of FIG. 4 with the runway folded fully onto the base plate.

With the ramp 30 in the flat position, the runway 10 is folded onto the base plate 22 as shown in FIG. 4. The runway 10 can be folded by placing the free end 10*a* of the runway 10 adjacent the hinged member 60 to form a fold 18 in the runway 10. The runway 10 is then folded a second time by placing the fold 18 adjacent the free end 10*a* and the hinged member 60 as shown in FIG. 5. It is envisioned that two folds may be sufficient to place the entire runway 10 on the base plate 22. However, if additional folds are required it is within the scope of the disclosure that the runway 10 may be folded in a range of once to six times to place the entire runway 10 on the base plate 22. When the runway 10 is folded onto the base plate 22, the legs 36 can be lifted such that the cross-member 37 is positioned over a portion of the runway 10 to secure the runway 10 against the base plate 22.

Figure 6:
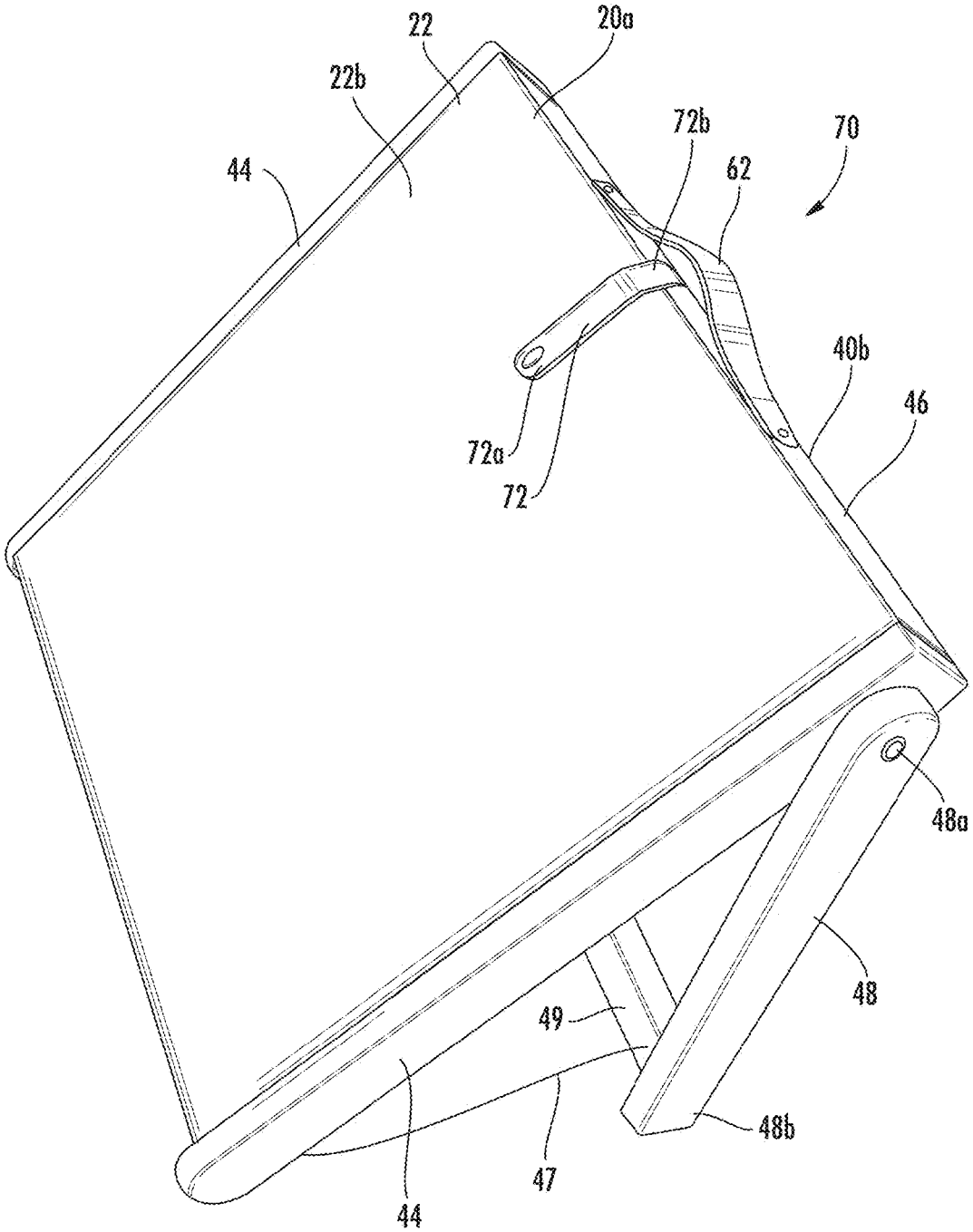
FIG. 6 is a perspective view of the gaming device of FIG. 5 with the base plate folded into a target.

With the runway 10 folded onto the base plate 22, the base plate 22 is folded up into the target 40 such that the backstop 46 is in contact the upper surface 22*a* of the base plate 22 adjacent the leading end 20*a* of the base 20 as shown in FIG. 6. When the base plate 22 is folded into the target 40, the sidewalls 44, backstop 46, and hinged member 60 (FIG. 5) form a box between the base plate 22 and the target plate 42 to enclose the runway 10 and the ramp 30. An upper surface of the sidewalls 44 may contact the upper surface 22*a* of the base plate 22 to close the box. In addition, the side rails 24 of the base plate 22 are disposed within the box and may contact the sidewalls 44 of the target plate 42. By enclosing the runway 10 and the ramp 30 within the box, the runway 10 and other gameplay surfaces (e.g., ramp 30 and target surface 50) are enclosed and protected from damage during transport and/or storage. Alternatively, the target 40 can be folded over the base plate 22 to enclose the runway 10 and the ramp 30 within the box.

Figure 7:
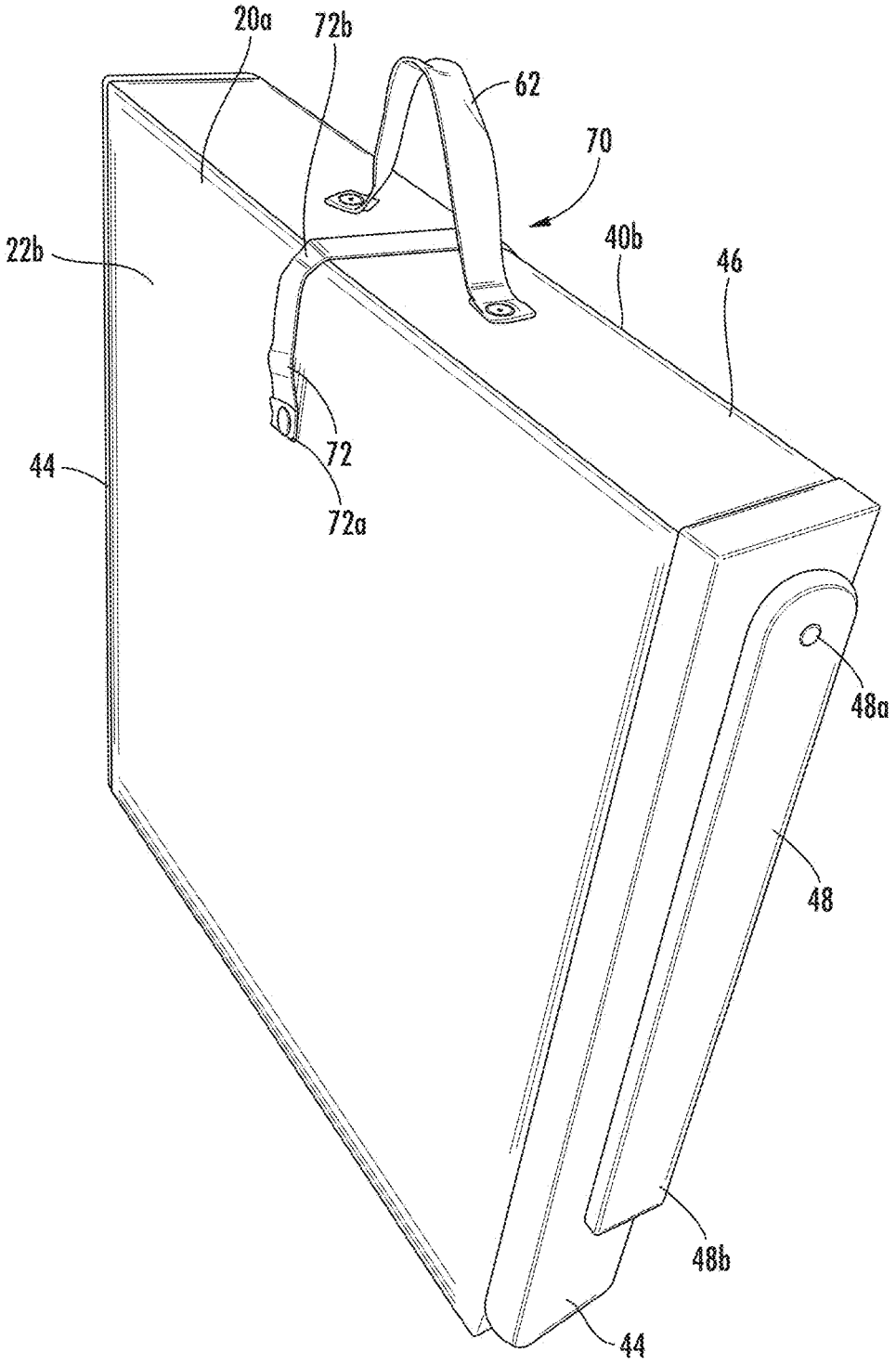
FIG. 7 is a perspective view of the gaming device of FIG. 1 in a transport configuration.
Figure 9:
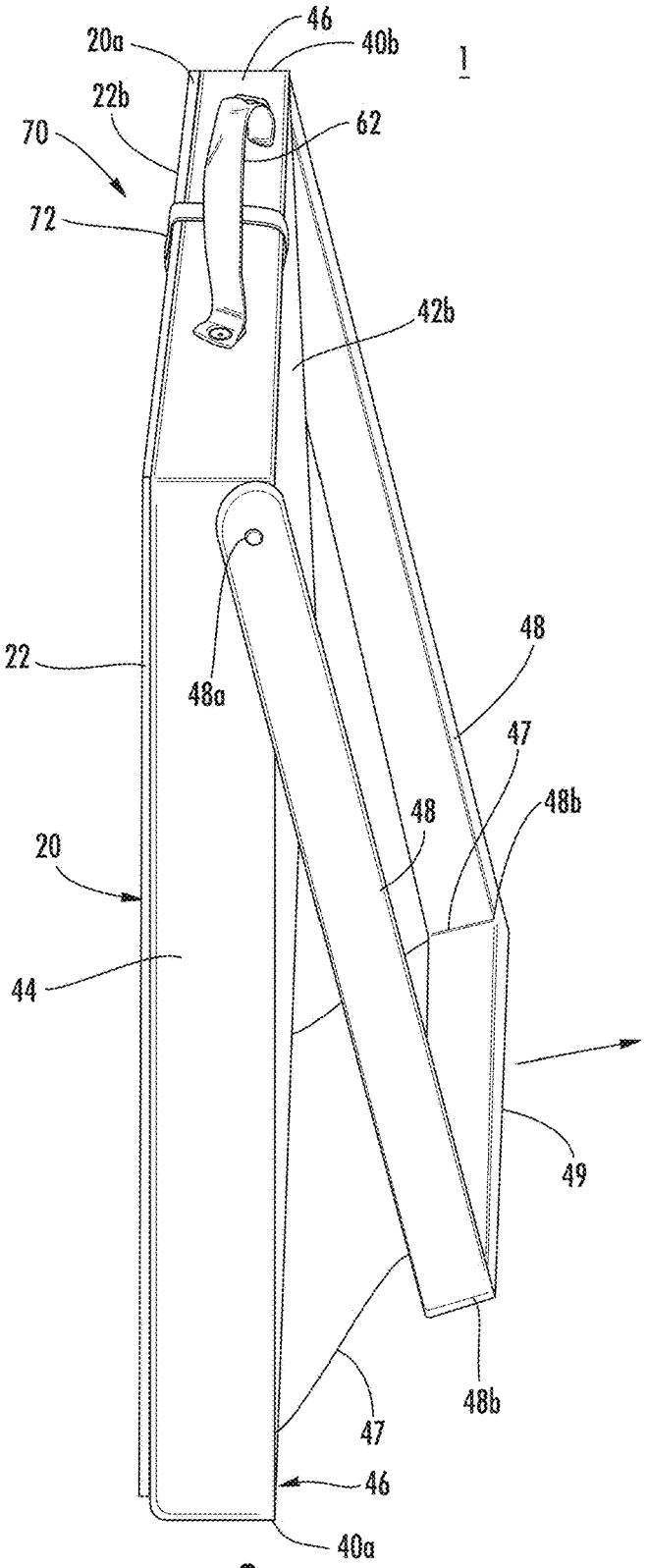
FIG. 9 is a perspective view of the gaming device of FIG. 7 with legs supporting the target in an inclined position.

With the runway 10 and the ramp 30 enclosed within the box, the trailing end 40*b* of the target 40 is secured to the leading end 20*a* of the base 20 with a closure device 70 as shown in FIG. 6. As shown, the closure device 70 is in the form of a closure strap 72 and a clasp 74. As shown in FIG. 9, The closure strap 72 has a first end 72*a* attached to the lower surface 22*b* of the base plate 22 and a second end 72*b* that is free extending from the first end 72*a*. The clasp 74 is attached to the outside surface 42*b* of the target plate 42 (FIG. 7). The second end 72*b* of the closure strap 72 is releasably secured to the clasp 74 to secure the target 40 over the base 20. As shown, the closure strap 72 and the clasp 74 are selectively secured together as a snap and button configuration. Alternatively, the closure strap 72 and the clasp 74 can secure together by other known methods including, but not limited to, tying, a loop and bar closure, a hook and eye closure, a tine and hole closure, a strap and clasp closure, etc.

With the closure strap 72 and the clasp 74 secured together, the handle 62 can be grasped to lift the gaming device 1 in the transport configuration as shown in FIG. 7. As gaming device 1 is lifted by the handle 62 in the transport configuration, the legs 48 rotate about the first ends 48*a* such that that second ends 48*b* rotate towards the outside surface 42*b* of the target plate 42. As the second ends 48*b* approach the outside surface 42*b*, the legs 48 may positioned on the sides of the target plate 42 adjacent the sidewalls 44. With the legs 48 positioned outside of the sidewalls 44, the cross-member 49 may contact the outside surface 42*b* to limit rotation of the legs 48. The retainers 47 may be wrapped around the legs 48 and/or the cross-member 49 to secure the legs 48 against the target plate 42.

Additionally or alternatively to the retainers 47, the legs 48 and the sidewalls 44 can include a ball and detent mechanism (not explicitly shown) to selectively lock the legs 48 in a plurality of positions relative to the sidewalls 44. Such a ball and detent mechanism could be positioned adjacent the first end 48*a* of one or both of the legs 48. A ball could be disposed within the sidewall 44 biased towards the leg 48. The leg 48 would define a plurality of detents on a surface facing the sidewall 44 such that the ball would be urged into one of the detents to lock the leg 48 in position relative to the sidewall 44. It is contemplated that the leg 48 defines a detent corresponding to the transport configuration in which the legs 48 are substantially aligned with the sidewalls 44 and the cross-member 49 is in contact with the outside surface 42*b* of the target plate 42 and a detent corresponding to the deployed configuration in which the legs 48 are rotated to support the target plate 42 at the angle α relative to the base plate 22. It is envisioned that the leg 48 can define multiple detents for the deployed configuration such that the angle α can have a plurality of discrete values in a similar manner to the angle θ of the ramp 30. It is within the scope of this disclosure that one or more of the legs 48 includes a ball biased towards a respective sidewall 44 with the sidewall 44 defining a plurality of detents in a manner similar to that detailed above with respect to the ball disposed in the sidewall 44 and the leg 48 defining a plurality of detents. The engagement of the ball with the plurality of detents can provide indicia or feedback when the leg 48 reaches a predetermined position relative to the sidewall 44. The feedback may be audible or tactile.

The base plate 22, the ramp 30, the target plate 42, and legs 38, 48 can be constructed of wood, plastic, metal, or a combination thereof. The hinged member 60 can be constructed of wood, leather, rubber, plastic, or other rigid, semi-rigid, or pliable material suitable for hingedly securing the target plate 42 to the base plate 22.

Figure 8:
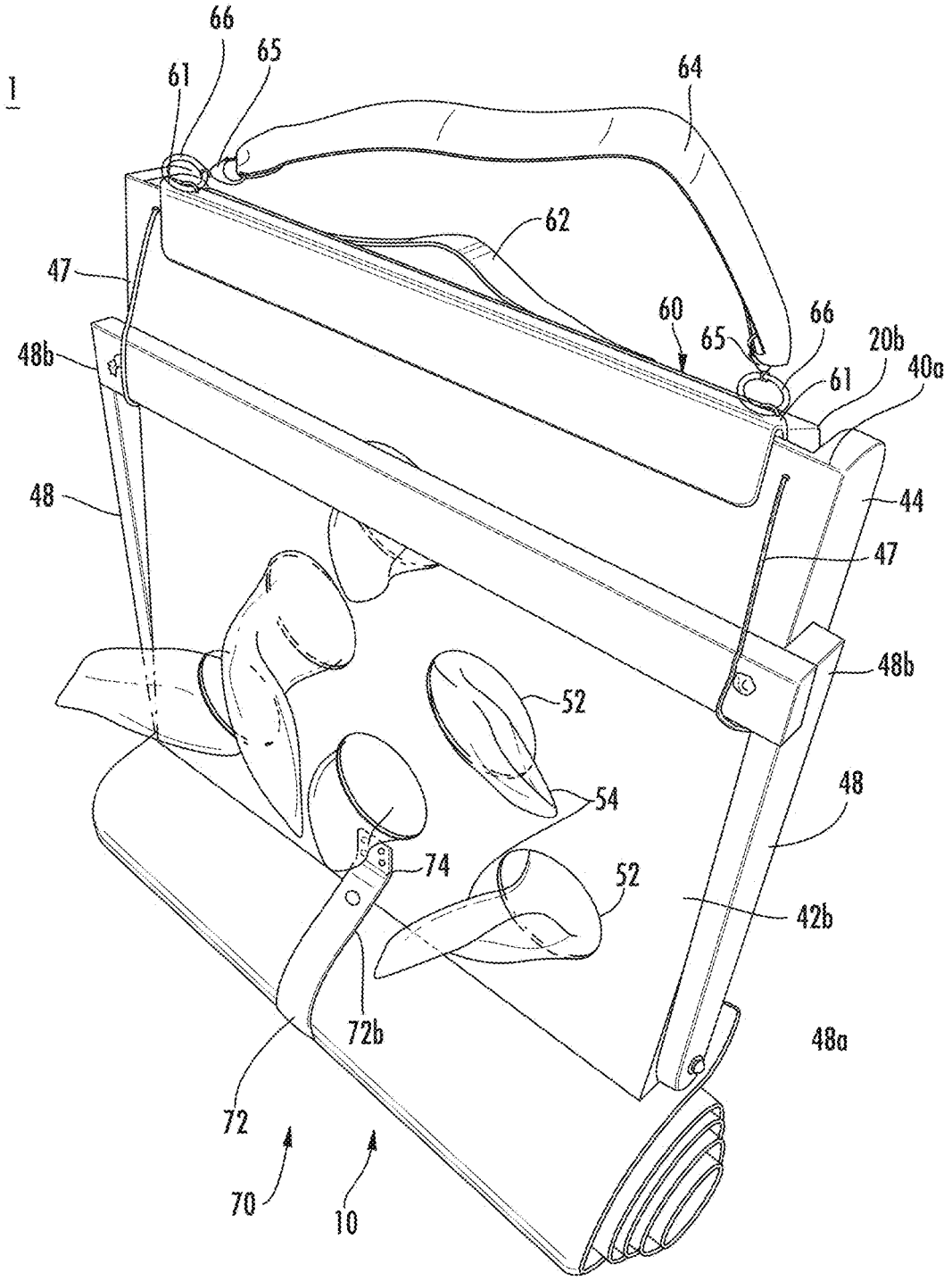
FIG. 8 is a perspective view of another gaming device in accordance with the present disclosure in a transport configuration with a runway rolled up and secured by a closure strap.

With reference to FIG. 8, it is envisioned that the runway 10 can be rolled up in the transport configuration instead of folded onto the base plate 22. To stow the runway 10 rolled up, the runway 10 is rolled up on itself from the free end 10*a* (FIG. 1) towards the base plate 22. When the runway 10 is rolled towards the base plate 22, the closure device 70 can be secured around the runway 10 to prevent the runway 10 from unintentionally unrolling. As shown, the closure strap 72 includes a button and the clasp 74 includes a snap. As shown, the closure device 70 has a fixed length; however, the closure device 70 can be adjustable to accommodate the runway 10 being rolled onto the base plate 22 with the closure device 70 secured around the runway 10 or the runway 10 being folded between the base 20 and the target 40. When the runway 10 is rolled up, the runway 10 may act as a pad for the bottom of the gaming device 1 in the deployed configuration.

Continuing to refer to FIG. 8, the handle 62 can be disposed on the hinged member 60 such that the trailing end 20*b* and the leading end 40*a* of the target plate 42 form a top end of the gaming device 1 in the transport configuration.

Figure 10:
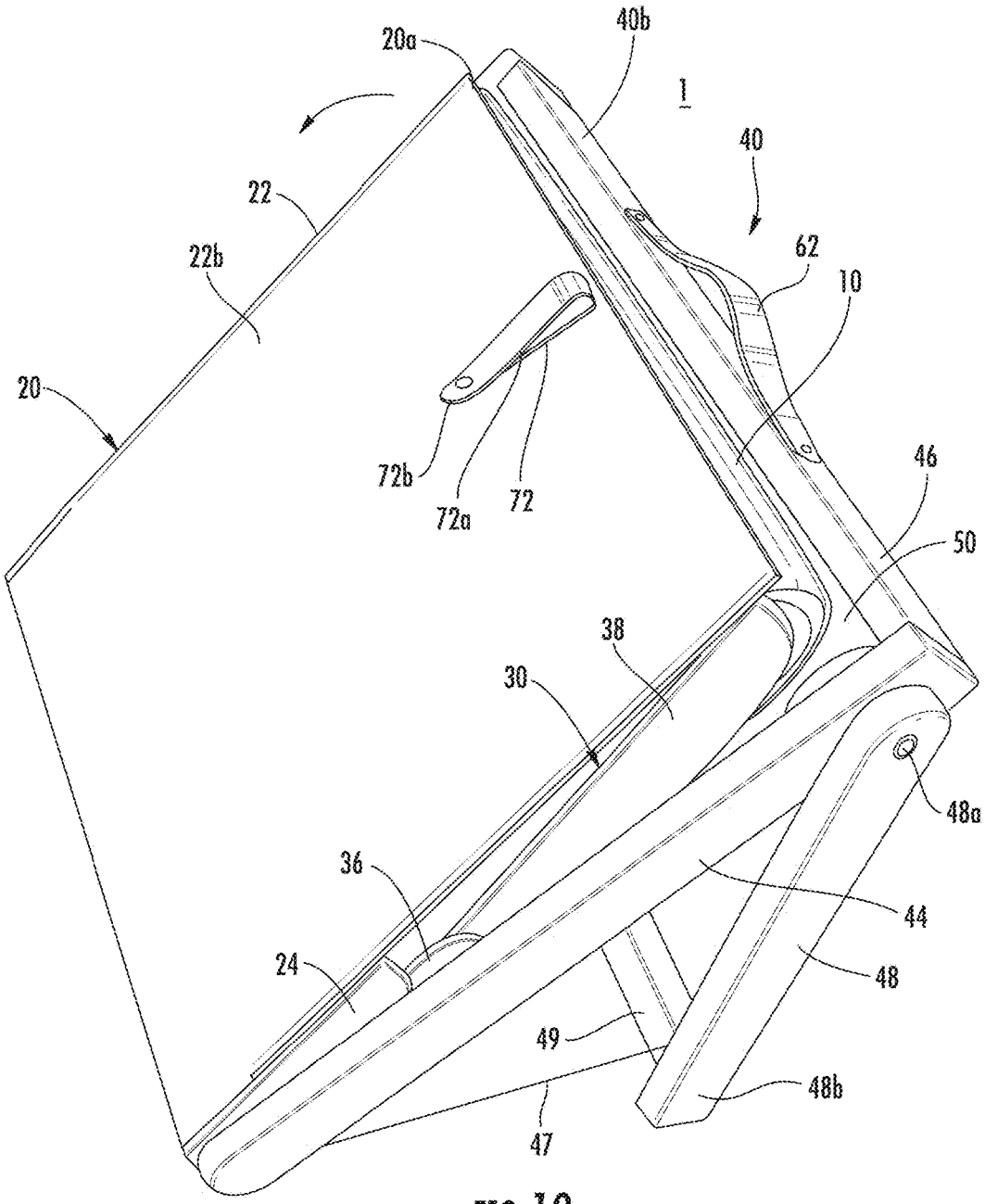
FIG. 10 is a perspective view of the gaming device of FIG. 9 with a closure strap released and the base plate folding out of the target box.

Referring now to FIGS. 9-13, a method of deploying the gaming device 1 from the transport configuration is described in accordance with the present disclosure. Initially referring to FIG. 9, the gaming device 1 is set on a suitable surface (e.g., the floor, a driveway, a parking lot, a lawn, a truck bed, etc.) in the transport configuration with the hinged member 60 (FIG. 1) on the surface and the target 40 substantially upright. If the second ends 48*b* are secured to the outside surface 42*b* of the target plate 42 by the retainers 47, the retainers 47 are manipulated to release the second ends 48*b* such that the legs 48 rotate such that the second ends 48*b* are spaced apart from the outside surface 42*b* until the retainers 47 are substantially taut. When the legs 48 and the sidewalls 44 include a ball and detent mechanism, the legs 48 are rotated away from the target plate 42 until the legs 48 are secured in a positioned in which the cross-member 49 is spaced apart from the outside surface 42*b* of the target plate 42 as shown in FIG. 9. The gaming device 1 is then tipped onto the legs 48 such that the target 40 is upwardly inclined and supported by the legs 48 as shown in FIG. 10.

With the gaming device 1 supported on the legs 48, the closure device 70 is released to allow the base 20 to open or fold away from the target 40 about the hinged member 60 as shown in FIG. 10. As the base 20 is opened, the lower surface 22*b* of the base plate 22 is laid on the surface and the target surface 50 of the target 40 is exposed.

Figure 11:
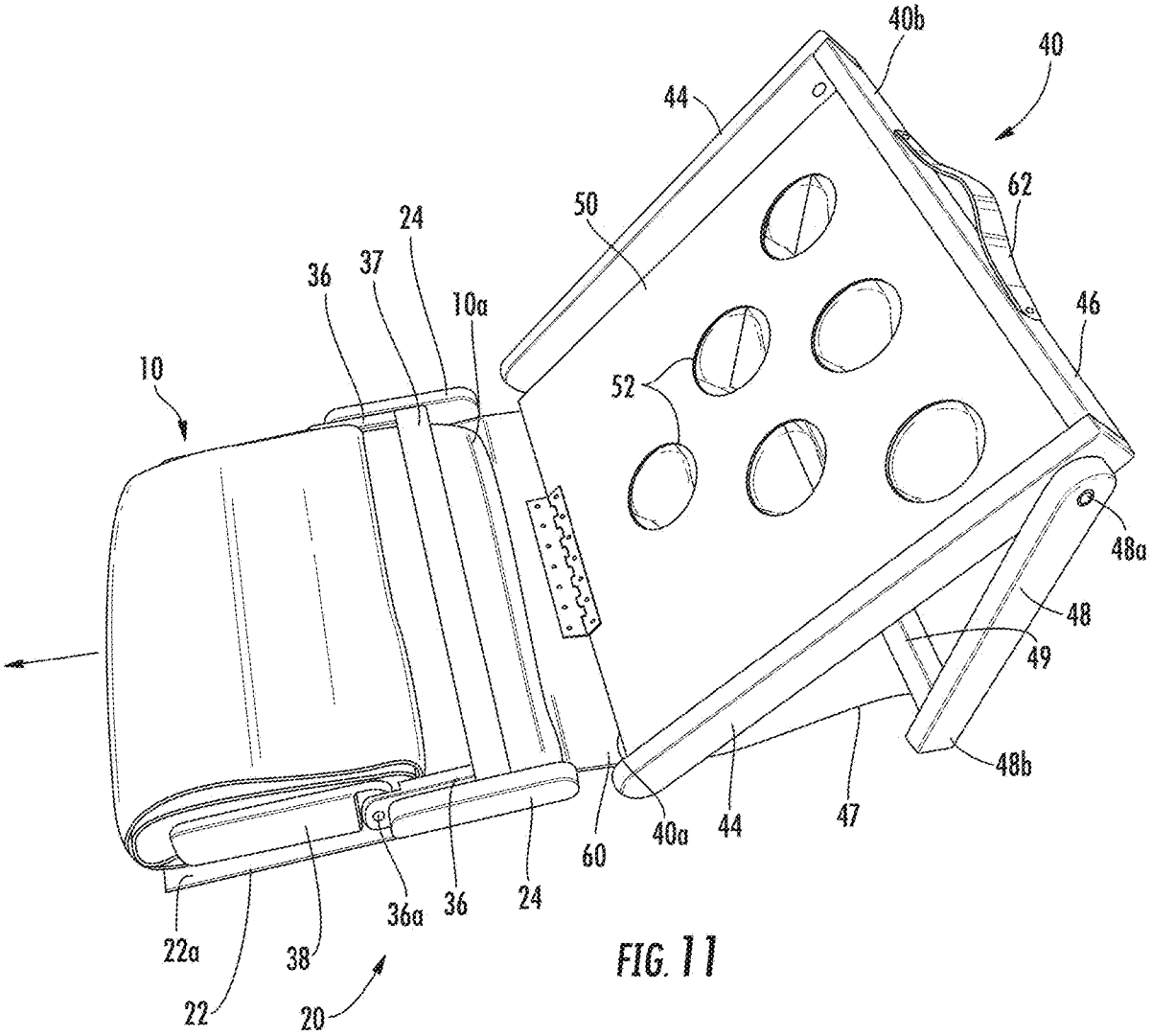
FIG. 11 is a perspective view of the gaming device of FIG. 10 with the base plate folded onto the ground and the runway folded over the base plate.
Figure 12:
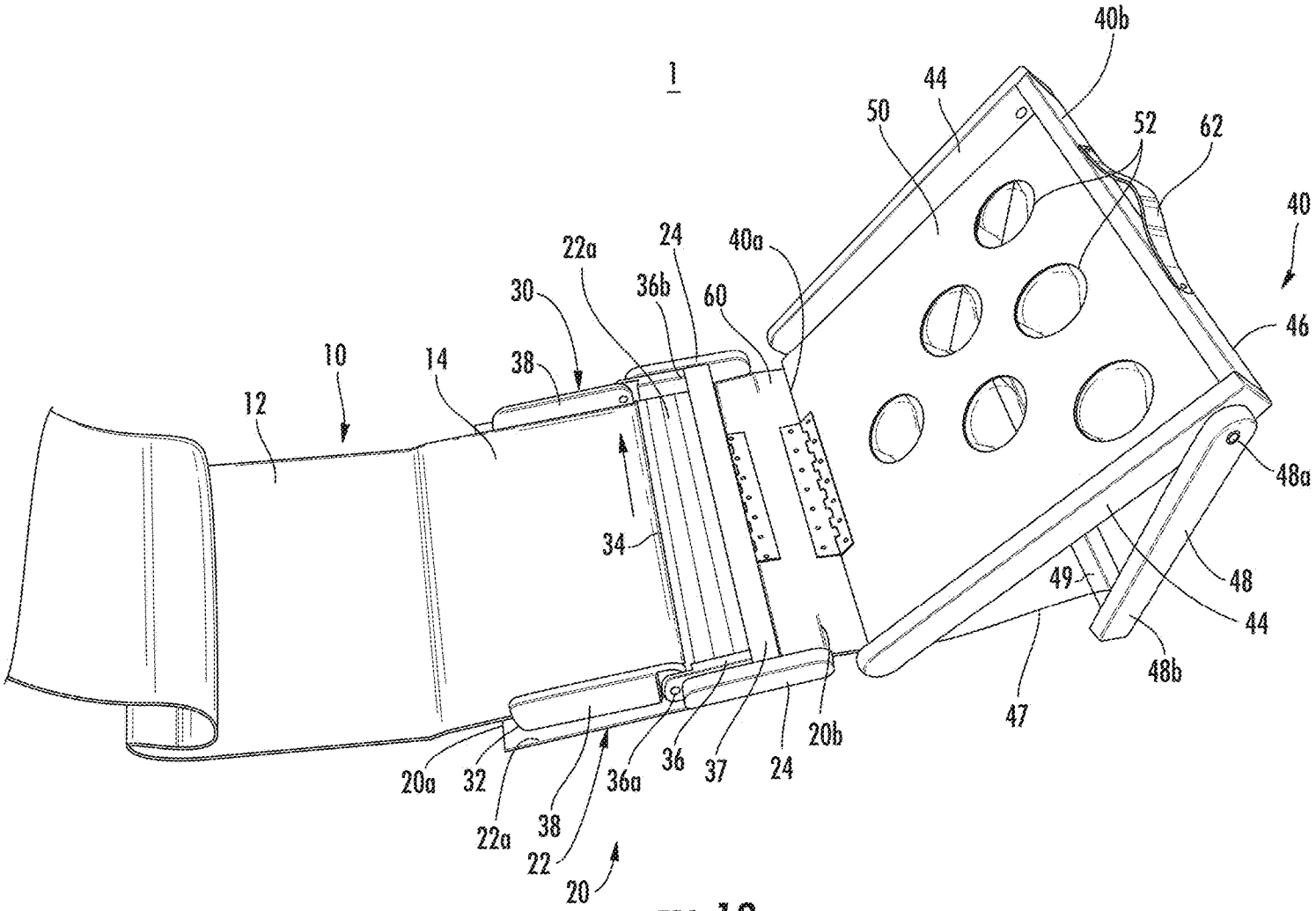
FIG. 12 is a perspective view of the gaming device of FIG. 11 with the runway partially deployed and the ramp in the flat position.

With the base 20 opened, the runway 10 is deployed by unfolding or unrolling the runway 10 away from the base plate 22 as shown in FIGS. 11 and 12. With the runway 10 deployed, the ramp 30 is lifted to the inclined position by grasping the trailing edge 34 and positioning the second ends 36*b* of the legs 36 onto the upper surface 22*a* of the base plate 22 as shown in FIG. 1. Alternatively, as shown in FIG. 13, the side surface 36*c* of the legs 36 adjacent the second end 36*b* of the legs 36 can be disposed within one of the grooves 23*a*-*c* such that an angle θ' is defined between the ramp 30 and the base plate 22 in the inclined position. With the ramp 30 in one of the inclined positions, the gaming device 1 is in the deployed configuration and ready for use.

Continuing to refer to FIG. 13, a method of playing a game with the gaming device 1 is described in accordance with the present disclosure. With the gaming device 1 in the deployed configuration, a first player places a ball 110 on the runway 10 adjacent the leading end 10*a*. As shown, the ball 110 is a golf ball. It is envisioned that other balls can also be used as the ball 110 consistent with this disclosure including, but not limited to, ping pong balls, rubber balls, marbles, whiffle balls, etc. The first player stands over the ball 110 and uses a putter 120, or other striking instrument, to strike the ball 110 over the ramp 30 and towards the target 40. After being struck, the ball 110 rolls down the runway 10 and off of the ramp 30 towards the target 40. After the ball 110 is launched off the trailing edge 34 of the ramp 30, the ball 110 contacts the target surface 50, passes through one of the holes 52 in the target surface 50, or flies past the target 40. If the ball 110 contacts the target surface 50, the ball may roll into one of the holes 52 or roll off of the target surface 50 onto the base plate 22. The backstop 46 and sidewalls 44 of the target 40 may guide the ball 110 onto the base plate 22 and prevent the ball 110 from being lost. If the ball 110 passes through one of the holes 52, the ball 110 is captured in one of the pockets 54. The ball 110 can be left in the pocket 54 or the particular hole 52 can be logged using a scoring system as described below. If the ball 110 flies past the target 40, the ball 110 should be retrieved. After the first player strikes the ball 110, the first player's turn is completed. A second player then takes a turn by placing a ball 110 on the runway 10 adjacent the leading end 10*a* and strikes the ball 110 in a similar manner to the first player. The ball 110 of the second player can be the same ball 110 as the first player or another ball 110. The balls 110 of each player can be visually distinguishable from one another such that if the balls 110 are left in the pockets 54, the balls 110 can be used as the scoring system. Gameplay continues alternating turns between the first and second players until one of the players passes a ball 110 through each of the holes 52 and is declared the winner of the game. It is contemplated that the first player can be a first team and the second player can be a second team with individual members of the first and second teams alternating turns until one team wins. It envisioned that the game can be played with between 1 and 10 players and any number of players on a particular team.

It is envisioned that the putter 120 and the ball 110 can be disposed within the box defined between the target plate 42 and the base plate 22 in the transport configuration.

Referring to FIGS. 14-17, a scoring system 200 used to track gameplay is described in accordance with the present disclosure. The scoring system 200 can be an application 213 on a mobile device 210 (e.g., a smartphone, a tablet, computer, etc.).

Figure 14:
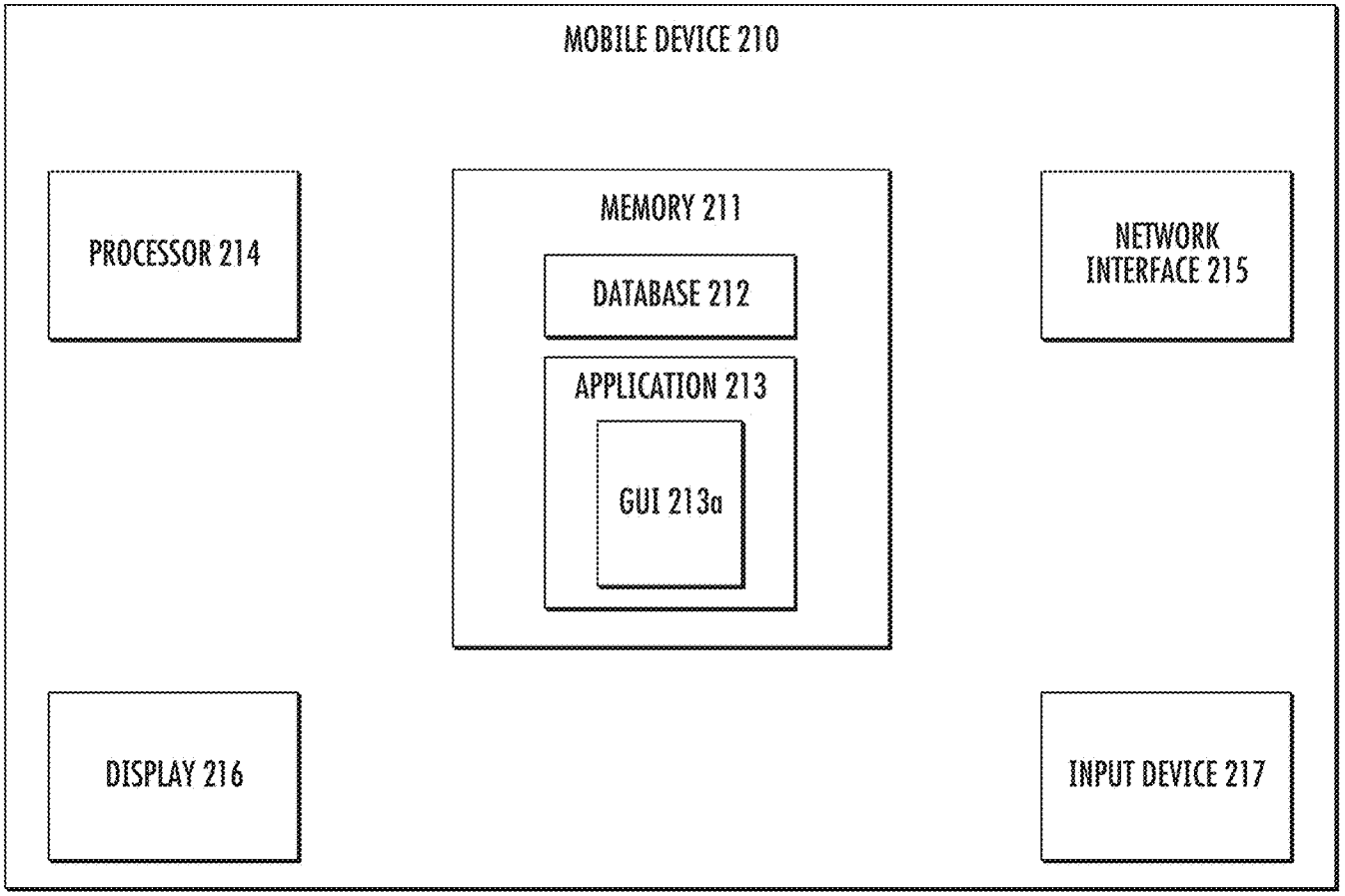
FIG. 14 is a schematic illustration of a mobile device in accordance with the present disclosure.

FIG. 14 shows a simplified block diagram of mobile device 210. Mobile device 210 may include a memory 211, a processor 214, a display device 216, a network interface 215, and/or an input device 217. Memory 211 may store application 213 and/or a database 212. Database 212 may store, among other things, player information, score information, image data, and/or multimedia elements. Application 213 may, when executed by processor 214, cause display device 216 to display a graphical user interface (GUI) 213*a* including one or more screens 300, described below with reference to FIGS. 15-17.

Memory 211 may include any non-transitory computer-readable storage media for storing data and/or software that is executable by processor 24 and which controls the operation of mobile device 210. In an embodiment, memory 211 may include one or more solid-state storage devices such as flash memory chips. Alternatively or in addition to the one or more solid-state storage devices, memory 211 may include one or more mass storage devices connected to the processor 214 through a mass storage controller (not shown) and a communications bus (not shown). Although the description of computer-readable media contained herein refers to a solid-state storage, it should be appreciated by those skilled in the art that computer-readable storage media can be any available media that can be accessed by the processor 214. That is, computer readable storage media includes non-transitory, volatile and non-volatile, removable and non-removable media implemented in any method or technology for storage of information such as computer-readable instructions, data structures, program modules or other data. For example, computer-readable storage media includes RAM, ROM, EPROM, EEPROM, flash memory or other solid state memory technology, CD-ROM, DVD, Blu-Ray or other optical storage, magnetic cassettes, magnetic tape, magnetic disk storage or other magnetic storage devices, or any other medium which can be used to store the desired information and which can be accessed by mobile device 210.

Processor 214 may be any single or collection of processors. In embodiments, processor 124 may be a central processing unit (CPU) configured to control mobile device 210. In further embodiments, processor 214 may be a dedicated graphical processing unit (GPU) specialized to perform graphics processing. Network interface 215 may be configured to connect to a network such as the internet. Input device 217 may be any device by means of which a user may interact with mobile device 210, such as, for example, a mouse, keyboard, foot pedal, touch screen, and/or voice interface.

Figure 15:
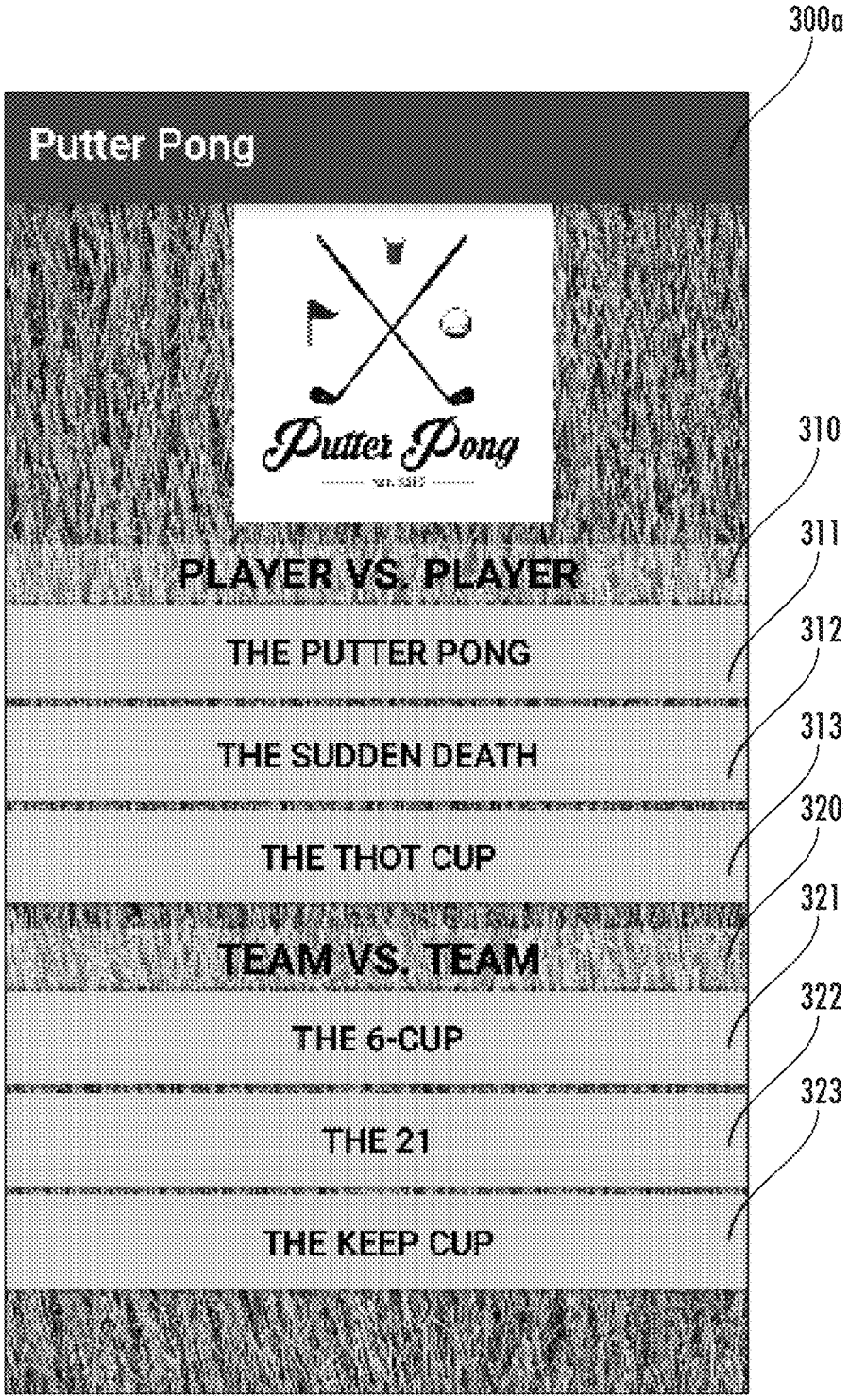
FIG. 15 is a view of a graphical user interface of an application on the mobile device of FIG. 14.

Turning now to FIG. 15, there is shown an example screen 300*a* of GUI 213*a*. Screen 300*a* may include various buttons allowing a user to select from various types of games that may be scored by application 213. For example, the buttons may be divided into a "PLAYER VS. PLAYER" section 310, denoting game types that may be played with only two participants, and a "TEAM VS. TEAM" section 320, denoting game types that may be played with multiple players on each team. Buttons may be provided for, among others, "THE PUTTER PONG" 311, "THE SUDDEN DEATH" 312, "THE THOT CUP" 313, "THE 6-CUP" 221, "THE 21" 322, and/or "THE KEEP CUP" 323 game types.

Figure 16:
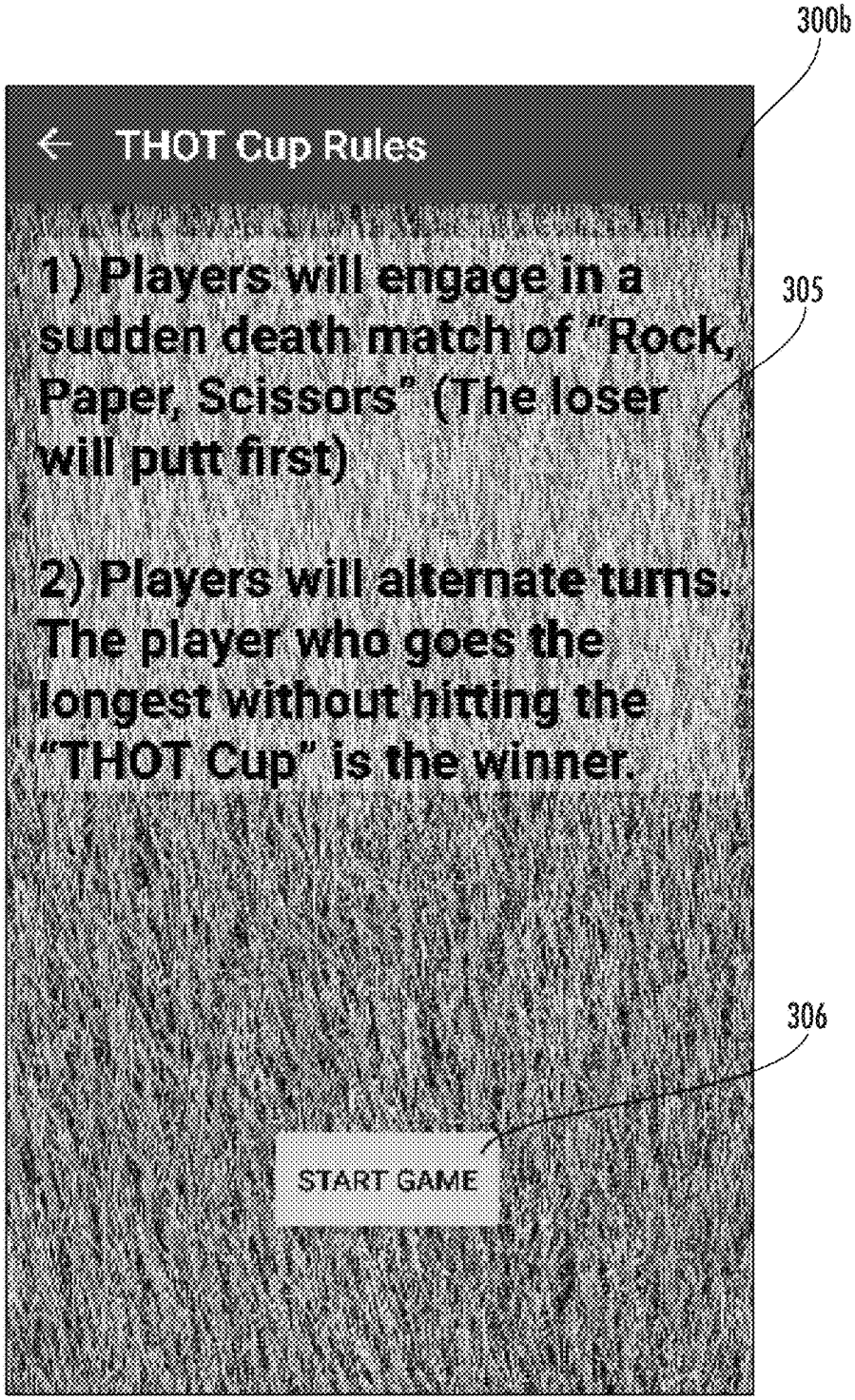
FIG. 16 is another view of a graphical user interface of an application on the mobile device of FIG. 14.

After receiving input from a user to select a game type, application 213 causes GUI 213*a* to display a rules screen 300*b*, as shown in FIG. 16. Screen 300*b* includes a rules section 305, showing the rules for the game type selected in screen 300*a*, and a start game button 333 which the user may select to start scoring the game.

Figure 17:
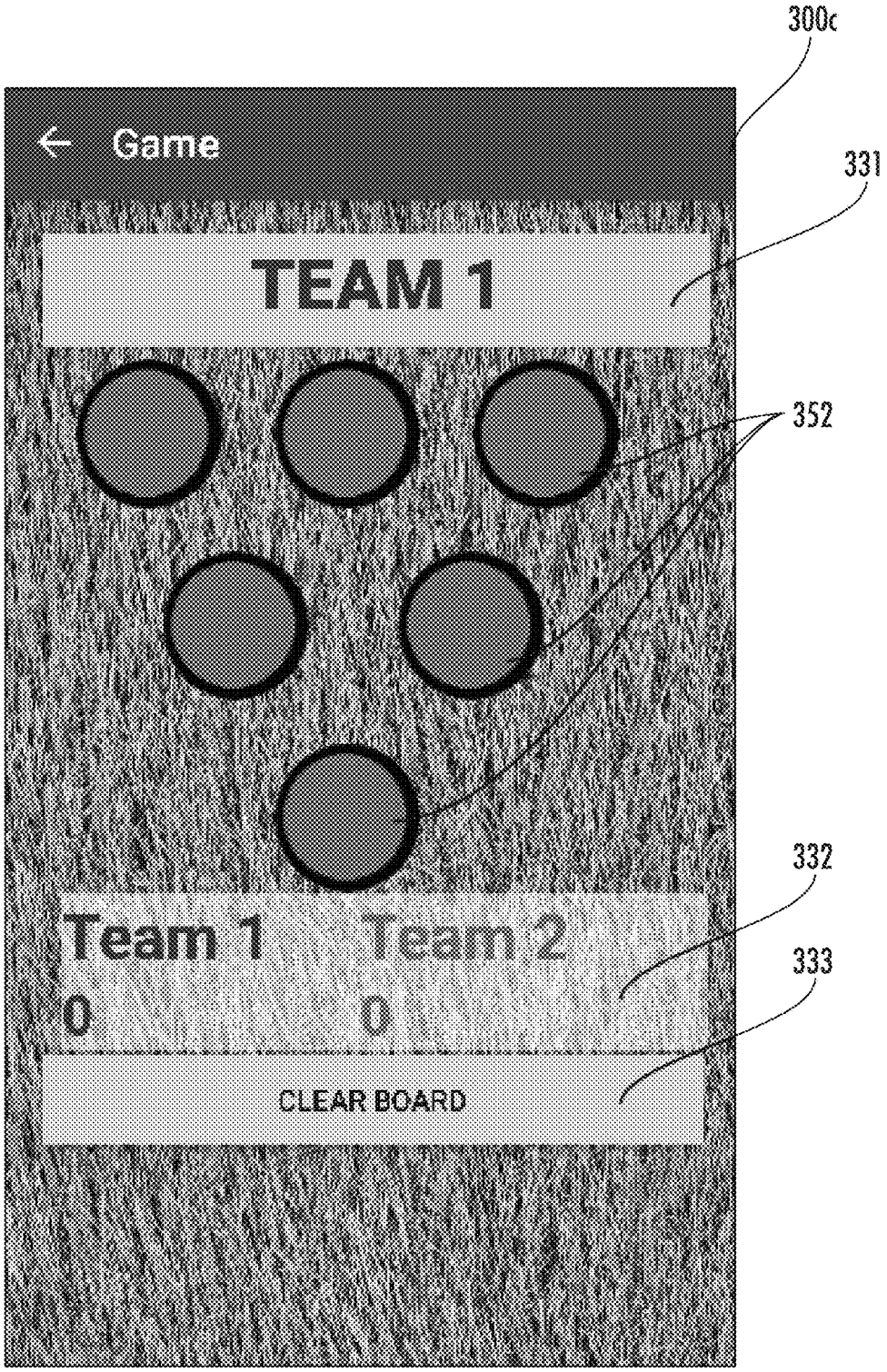
FIG. 17 is another view of a graphical user interface of an application on the mobile device of FIG. 14.

With reference to FIG. 17, there is shown an example scoring screen 300*c* of GUI 213*a*. Screen 300*b* may include, among other things, a "TEAM" button 331, which allows the user to select which team is being scored. In an embodiment where a "PLAYER VS. PLAYER" game type is being scored, button 331 will allow the user to select which player is being scored. After selecting the team with button 331, scores may be entered by selecting one or more of hole buttons 352, each hole button 352 corresponding to a hole 52, described above. When the user selects one or more of hole buttons 352, application 213 updates the score for the selected team, and displays the current score at score section 332. If the user wishes to reset score entry, the user may select "CLEAR BOARD" button 333, which will unselect any hole buttons 352 selected on the board. After receiving scores for a game, application 213 may store the received scores in database 212.

While several embodiments of the disclosure have been shown in the drawings, it is not intended that the disclosure be limited thereto, as it is intended that the disclosure be as broad in scope as the art will allow and that the specification be read likewise. Any combination of the above embodiments is also envisioned and is within the scope of the appended claims. Therefore, the above description should not be construed as limiting, but merely as exemplifications of particular embodiments. Those skilled in the art will envision other modifications within the scope of the claims appended hereto.

What is claimed:

1. A gaming device comprising:

a base including a base plate and a ramp, the base plate having an upper surface, a leading end, and a trailing end, the ramp including a ramp leg that supports the ramp in an inclined position, the ramp leg having a first end that is rotatably secured to the ramp and a second end that rests on the upper surface of the base plate to support the ramp in the inclined position;

a runway having a free end extending from the leading end of the base plate in a deployed configuration of the gaming device; and a target including a target plate having a target surface defining a plurality of holes, the target plate hingedly attached to the base plate such that the base plate is foldable into the target in a transport configuration of the gaming device, wherein in the transport configuration, the upper surface of the base plate opposes the target surface of the target plate with the ramp disposed between the upper surface and the target surface.

2. The gaming device according to claim 1, wherein the runway folds onto the base plate in the transport configuration of the gaming device such that the runway is disposed between the upper surface of the base plate and the target surface of the target plate in the transport configuration.

3. The gaming device according to claim 1, wherein the runway includes a lead-up section that extends from the leading end of the base plate and a ramp section that is disposed over the ramp.

4. The gaming device according to claim 1, wherein the ramp has a flat position in which an underside of the ramp is in contact with the upper surface of the base plate.

5. The gaming device according to claim 4, wherein in the flat position of the ramp, the ramp leg extends from a trailing edge of the ramp towards the trailing end of the base plate.

6. The gaming device according to claim 5, wherein in the flat position of the ramp, a side surface of the ramp leg is in contact with the upper surface of the base plate.

7. The gaming device according to claim 1, wherein the upper surface of the base plate defines a first groove and a second groove, wherein in the inclined position of the ramp, the second end of the ramp leg is disposed in the first groove such that the ramp defines a first angle with the upper surface of the base plate, and wherein in an intermediate position of the ramp, the second end of the ramp leg is disposed in the second groove such that the ramp defines a second angle with the upper surface of the base plate different from the first angle.

8. The gaming device according to claim 1, wherein the target includes sidewalls and a backstop both extending from an inside surface of the target plate, the sidewalls and the backstop forming a box with the target plate which contains the runway and the ramp in the transport configuration of the gaming device.

9. The gaming device according to claim 8, wherein a leading end of the base plate is adjacent the backstop in the transport configuration of the gaming device.

10. The gaming device according to claim 1, wherein the target includes a pair of support legs, each support legs having a first end rotatably attached to a respective sidewall of the target adjacent a trailing end of the target and a second end extending away from the first end, the second end supporting the target in an inclined position in the deployed configuration of the gaming device.

11. The gaming device according to claim 10, wherein the target includes a cross-member interconnecting the second ends of the support legs.

12. The gaming device according to claim 11, wherein the target includes a retainer having a first end secured to the target plate adjacent a leading end thereof and to the cross-member.

13. The gaming device according to claim 12, wherein the retainer sets a target angle between the upper surface of the base plate and the target plate in a deployed configuration of the gaming device when the second end of the target leg and the leading end of the target plate are supported on a common surface.

14. A gaming device comprising:

a base including a base plate and a ramp, the base plate having an upper surface, a leading end, and a trailing end, the ramp including a ramp leg that supports the ramp in an inclined position, the ramp leg having a first end that is rotatably secured to the ramp and a second end that rests on the upper surface of the base plate to support the ramp in the inclined position;

a runway having a free end extending from the leading end of the base plate in a deployed configuration of the gaming device;

a target including a target plate having a target surface defining a plurality of holes, the base plate being foldable into the target in a transport configuration of the gaming device; and a hinge secured to the trailing end of the base plate and to the leading end of the target plate to hingedly attach the base plate to the target plate, the hinge including a handle accessible when the gaming device is in the transport configuration, wherein in the transport configuration, the upper surface of the base plate opposes the target surface of the target plate with the ramp disposed between the upper surface and the target surface.

15. A method of deploying a gaming device, the method comprising:

placing the gaming device on a surface in a transport configuration with a leading end of a target plate adjacent the surface;

tipping the target plate onto support legs such that a target surface of the target plate defines a target angle with the surface;

pivoting a base plate from the transport configuration in which an upper surface of the base plate opposes the target surface of the target plate such that a bottom surface of the base plate is supported by the surface and the upper surface of the base plate defines the target angle with the target plate, the bottom surface being opposite the upper surface;

extending a runway from the base plate in a direction away from the target plate; and lifting a trailing edge of a ramp that is hingedly attached at a leading edge to the upper surface of the base plate such that an upside of the ramp defines a ramp angle with the upper surface of the base plate.

16. The method according to claim 15, further comprising releasing the support legs from against an outside surface of the target plate before tipping the target plate onto the support legs.

17. The method according to claim 15, further comprising rotating the support legs about a first end of each leg such that a second end of each support leg is spaced apart from a leading end of the target plate a predetermined distance.

18. The method according to claim 15, wherein placing the gaming device on the surface includes placing a bottom surface of the base plate on the surface and tipping the target plate onto the support legs includes lifting a trailing end of the target plate away from the leading end of the base plate.

19. The method according to claim 15, wherein lifting the trailing edge of the ramp includes rotating a ramp leg about a first end of the ramp leg, which is rotatably coupled to the ramp adjacent the trailing edge of the ramp, such that a second end of the ramp leg is supported on the upper surface of the base plate, an upside of the ramp defining predetermined ramp angle with the upper surface of the base plate when the second end of the ramp leg is supported on the upper surface of the base plate.

20. The method according to claim 15, further comprising adjusting the ramp angle by moving an end of a ramp leg pivotally coupled to the ramp from a first groove defined in the upper surface of the base plate to a second groove defined in the upper surface of the base plate.

* * * * *